US007334402B2

(12) United States Patent
Hiraga

(10) Patent No.: US 7,334,402 B2
(45) Date of Patent: Feb. 26, 2008

(54) EXHAUST SYSTEM WITH CATALYTIC CONVERTER AND MOTORCYCLE USING THE SAME

(75) Inventor: Takashi Hiraga, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/443,908

(22) Filed: May 31, 2006

(65) Prior Publication Data

US 2006/0283180 A1 Dec. 21, 2006

(30) Foreign Application Priority Data

Jun. 17, 2005 (JP) ..... 2005-177789
Jun. 27, 2005 (JP) ..... 2005-187049

(51) Int. Cl.
*F02B 27/02* (2006.01)

(52) U.S. Cl. ..... 60/312; 60/324; 181/255; 181/272

(58) Field of Classification Search ..... 60/299, 60/312, 314, 324; 181/232, 255, 256, 257, 181/269, 272, 275
See application file for complete search history.

(56) References Cited

U.S. PATENT DOCUMENTS 3,445,196 A * 5/1969 Thomas ..... 422/180
4,809,800 A * 3/1989 Suzuki ..... 180/219
5,043,147 A * 8/1991 Knight ..... 60/299
5,218,817 A * 6/1993 Urata ..... 60/274
5,376,341 A * 12/1994 Gulati ..... 422/179
5,392,602 A * 2/1995 Matsumoto ..... 60/299
5,519,994 A * 5/1996 Hill ..... 60/313
6,213,827 B1 * 4/2001 Hattori et al. ..... 440/89 R
6,619,426 B2 * 9/2003 Minami et al. ..... 181/251

FOREIGN PATENT DOCUMENTS

JP 6-18639 11/1994

* cited by examiner

*Primary Examiner*—Thomas Denion
*Assistant Examiner*—Diem Tran

(57) ABSTRACT

A catalytic converter-incorporated exhaust system is provided, which includes an exhaust tube through which exhaust gases emitted from an engine flow, and a muffler fluidly connected with a downstream end of the exhaust tube. This muffler includes a muffler casing having a plurality of expansion chambers defined therein, an exhaust introducing passage for introducing the exhaust gases from the exhaust tube into the expansion chambers in succession, two catalytic converters mounted in an downstream portion of the exhaust introducing passage and operable to substantially purify the exhaust gases, and an exhaust composition detecting sensor disposed outside the muffler casing in the exhaust introducing passage.

15 Claims, 14 Drawing Sheets

EXHAUST SYSTEM WITH CATALYTIC CONVERTER AND MOTORCYCLE USING THE SAME

BACKGROUND OF THE INVENTION

1. Field of the Invention

The present invention relates to an exhaust system having a catalytic converter built therein for removing obnoxious emission components from exhaust gases from a combustion engine and also for reducing engine exhaust noises. The present invention relates also to a motorcycle having the exhaust system referred to above.

2. Description of the Prior Art

The motorcycle exhaust system with a catalytic converter built therein and fluidly connected with the motorcycle combustion engine is generally so designed and so structured that exhaust gases introduced towards a muffler through an exhaust tube that is fluidly connected with an exhaust port of the motorcycle engine may be first introduced into an expansion chamber, defined in an upstream region of an exhaust passage within the muffler, and be subsequently passed through a catalytic converter disposed downstream of the expansion chamber with respect to the direction of flow of the exhaust gases towards the atmosphere. In this motorcycle exhaust system, it is well known that as the exhaust gases flow through the expansion chamber within the muffler, the exhaust gases can be expanded, accompanied by reduction of the exhaust energies and flow velocity of the exhaust gases so that the flow resistance of the exhaust gases ready to pass through the catalytic converter can be reduced.

In the catalytic converter-incorporated exhaust system of the kind discussed above, if the total quantity of oxygen contained in the exhaust gases can be utilized to reburn unburned obnoxious components of the exhaust gases that are left as the exhaust gases pass through the catalytic converter, the exhaust gases can be substantially purified to such an extent as to contain no substantial quantity of the obnoxious components, with the catalytic converter thus exhibiting an excellent purifying performance. In order to accomplish the substantial purification of the exhaust gases in this way, it is desirable to control the engine exhaust gases to contain a predetermined or required quantity of oxygen and, specifically, to control the air-fuel mixture to have an air/fuel mixing ratio that is about equal to the stoichiometric air/fuel mixing ratio of 14.8. In view of this, the Japanese Laid-open Utility Model Publication No. 6-18639, first published Mar. 11, 1994, for example discloses the use of a sensor for detecting the amount of oxygen contained in the exhaust gases introduced into the muffler so that a fuel supply control device can control, on a feedback scheme, the amount of fuel to be supplied to the combustion engine in dependence on a detection signal generated by the sensor.

However, with the prior art catalytic converter-incorporated exhaust system discussed above, the exhaust gases are introduced into and then purified substantially within the catalytic converter after it has first been introduced into the expansion chamber. Since the exhaust gases expanded within the expansion chamber have their flow velocity lowered on one hand and have a static pressure increased on the other hand and, therefore, a portion of the exhaust gases of the increased pressure tends to leak outwardly through a gap between a partition wall, used in the muffler to form the expansion chamber, and an inner surface of the muffler casing to such an extent that the total amount of the exhaust gases cannot be passed through the catalytic converter, resulting in reduction of the exhaust gases purifying performance. On the other hand, if the sensor for detecting the amount of oxygen contained in the exhaust gases is disposed within such expansion chamber positioned at a location immediately upstream the catalytic converter to detect the amount of oxygen contained in the exhaust gases, the amount of oxygen contained in the exhaust gases at the time they have been just exhausted from the vehicle engine cannot be detected accurately because oxygen contained in the exhaust gases then entering the expansion chamber is mixed within the expansion chamber with oxygen which was contained in the preceding exhaust gases and was left within such expansion chamber. As a result, the feedback control of the amount of fuel to be supplied in dependence on the detection signal outputted from the sensor will have a low or slow response and the amount of oxygen contained in the exhaust gases then passing through the catalytic converter may not attain a required value, with the consequence that the exhaust gases may not be substantially purified sufficiently.

SUMMARY OF THE INVENTION

Accordingly, the present invention has been devised to substantially eliminate the problems and inconveniences inherent in the prior art exhaust system of a type having a catalytic converter disposed thereon and is intended to provide an improved catalytic converter-incorporated exhaust system for a vehicle, in which a substantially total amount of exhaust gases introduced through an exhaust tube can be introduced into the catalytic converter without any leakage thereof and in which the catalytic converter can exercise its full purifying performance to remove obnoxious components of the exhaust gases as much as possible.

It is a related object of the present invention to provide a motorcycle equipped with the exhaust gas system of the type referred to above.

In order to accomplish these and other objects and features of the present invention, there is provided a catalytic converter-incorporated exhaust system, which includes an exhaust tube through which exhaust gases emitted from an engine flow, and a muffler fluidly connected with a downstream end of the exhaust tube and including a muffler casing. This muffler casing has at least one expansion chamber defined therein, into which the exhaust gases from the exhaust tube are introduced through an exhaust introducing passage. An catalytic converter assembly for substantially purifying the exhaust gases is mounted in an downstream portion of the exhaust introducing passage and positioned upstream of the expansion chamber, and an exhaust composition detecting sensor is disposed within the exhaust introducing passage at a location outside the muffler casing.

According to the present invention, since the catalytic converter is disposed in the downstream portion of the exhaust introducing passage and upstream of the expansion chamber, the exhaust gases can be substantially purified through the catalytic converter prior to being introduced into the expansion chamber and, therefore, the total amount of the exhaust gases introduced into the muffler casing can be assuredly passed through the catalytic converter with no leakage, to thereby accomplish substantial purification of the exhaust gases.

Also, since the quantity of components of the exhaust gases introduced from the engine into the exhaust tube, for example, the quantity of oxygen contained therein, is detected by the exhaust composition detecting sensor, disposed outside of the muffler casing, prior to the exhaust gases being introduced into the expansion chamber, the fuel supply control device, for example, can perform a feedback control in dependence on a detection signal, outputted from the exhaust composition detecting sensor, to adjust the air/fuel mixing ratio of an air-fuel mixture to be supplied towards the engine, to attain a predetermined value. Accordingly, unlike the case in which the component of the exhaust gases, which have been introduced into and have therefore been expanded within the expansion chamber, is detected such as accomplished in the prior art, the quantity of the component such as oxygen contained in the exhaust gases before being introduced into the catalytic converter, can be controlled to a predetermined or required value with high response. Therefore, the catalytic converter can exhibit the purifying performance to the maximum limit, resulting in effective removal of the obnoxious components from the exhaust gases.

In a preferred embodiment of the present invention, the exhaust introducing passage may be of a shape extending from one end wall of the muffler casing, which has an inlet, to the opposite end wall thereof through an interior of the muffler casing and having a generally U-shaped turnback passage portion around which the exhaust introducing passage is turned backwards to extend towards such one end wall of the muffler casing. According to this particular shape, the exhaust introducing passage through which the exhaust gases are supplied to the expansion chamber can have a length sufficient to allow the exhaust gases to make approximately one round trip from one end wall of the muffler casing to the opposite end wall thereof. Since the length of the exhaust passage from the engine to the expansion chamber can be increased, the exhaust inertia brought about by pulsating flow of the exhaust gases can be effectively utilized to enhance the exhaust efficiency.

In another preferred embodiment of the present invention, the muffler casing may have an upstream expansion chamber defined therein at a location frontward of the muffler casing for receiving the exhaust gases, which have passed through the catalytic converter assembly, and may also have one or more downstream expansion chambers defined therein at a location rearwardly of the upstream expansion chamber. According to this structural feature, the exhaust introducing passage can have an elongated shape enough to allow the exhaust gases to make approximately one round trip from one end wall of the muffler casing to the opposite end wall thereof and, at the same time, the plural expansion chambers can be formed in multi-stages to enhance the silencing effect.

In a further preferred embodiment of the present invention, the muffler casing is provided with a plurality of expansion chambers. In such case, those expansion chambers are defined within the muffler casing by mean of partition walls, and a plurality of communicating tubes are employed to communicate between the expansion chambers and between one of the expansion chambers and an outside. At least one of the communicating tubes may have at least one end face thereof, which is held in abutment with the partition wall. One end of this at least one of the communicating tubes may be provided with an opening through which the exhaust gases flow between the communicating tube and the expansion chamber.

According to this structural feature, when the exhaust system is assembled, after a muffler assembly has been manufactured with the communicating tubes fixedly passed completely across the plural partition walls, the muffler assembly can be inserted into the muffler casing of a generally short pipe shape from an opening at one end thereof to occupy a predetermined position inside the muffler casing. At this time, the partition wall of the muffler assembly so structured as described above can be reinforced by the communicating tube having at least one end face held in abutment therewith and, therefore, an undesirable deformation of the partition wall under the influence of a frictional force developed during the insertion can be prevented advantageously.

According to another aspect of the present invention, there is also provided a motorcycle equipped with the catalytic converter-incorporated exhaust system of the structure described hereinbefore. The muffler of the exhaust system employed in the motorcycle is preferably positioned between the engine and a rear wheel of the motorcycle.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, the present invention will be described in detail in connection with preferred embodiments thereof with reference to the accompanying drawings.

Figure 1:
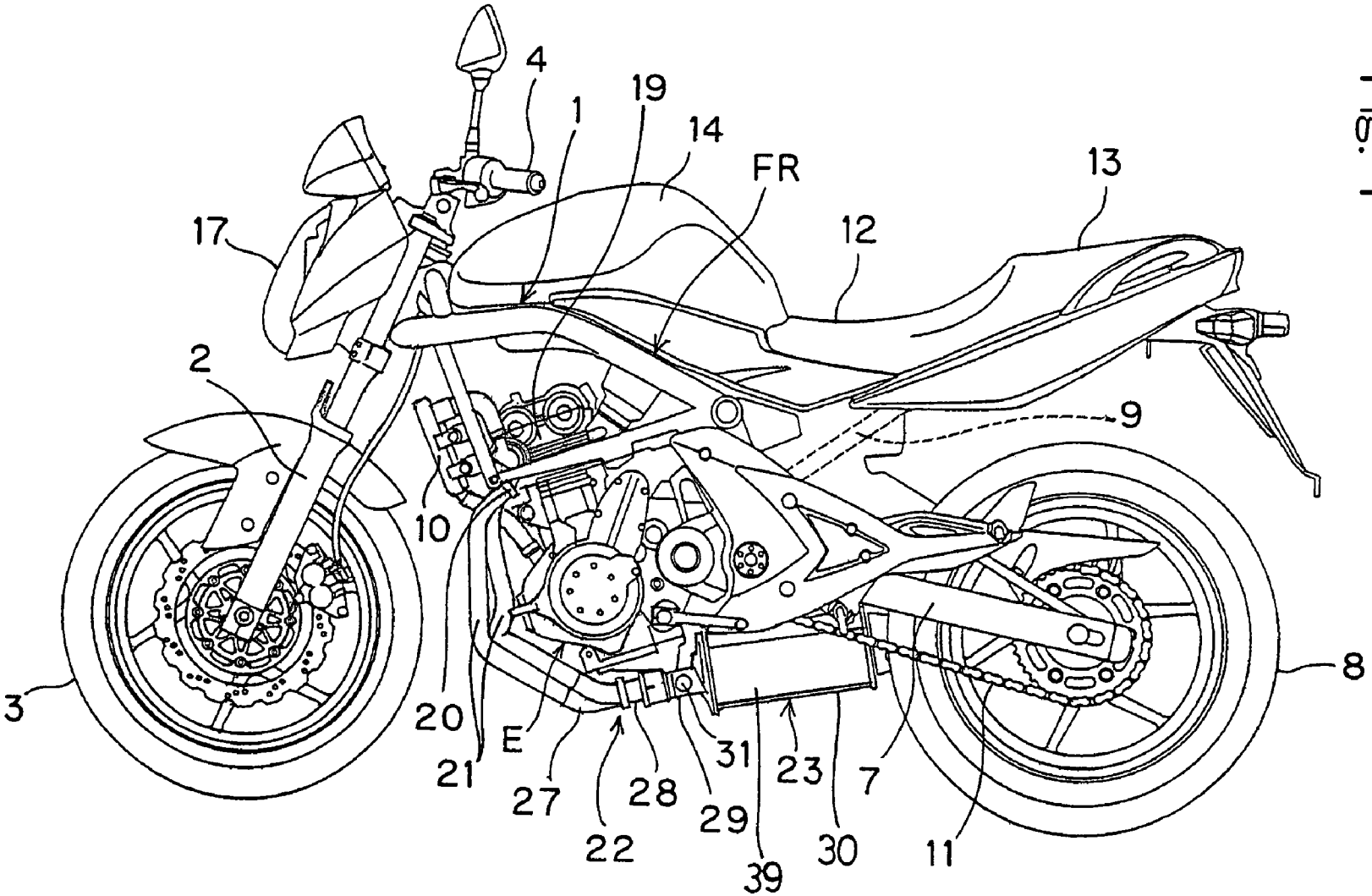
FIG. 1 is a side view of a motorcycle equipped with an exhaust system designed in accordance with a preferred embodiment of the present invention.

Referring to FIG. 1, showing in a side view a motorcycle equipped with an exhaust system according to the present invention, the motorcycle shown therein includes a motorcycle frame structure FR made up of a front frame portion, which is represented by a main frame 1, and a rear frame portion including seat rails 9 rigidly connected with a rear end portion of the main frame 1.

The main frame 1 has a front steering fork assembly 2 supported thereby, which assembly 2 in turn supports rotatably a front wheel 3 at a lower portion thereof in a known manner. A steering handlebar 4 is rigidly mounted on an upper portion of the steering fork assembly 2. A rear lower portion of the main frame 1 is provided with a swing arm bracket (not shown), and a swing arm 7 has a front end connected to the swing arm bracket through a pivot pin (not shown) so that the swing arm 7 can pivot up and down. The swing arm 7 also has a rear end on which a rear wheel 8 is rotatably mounted. A motorcycle engine E, for example, an a four stroke cycle combustion engine is mounted on a lower portion of the main frame 1, with a radiator 10 positioned forwardly of the motorcycle engine E.

The seat rails 9 support a rider's seat 12 and a fellow passenger's seat 13 mounted on the seat rails 9. A fuel tank 14 is fixedly mounted on an upper portion of the main frame 1 and between the handlebar 4 and the rider's seat 12. A headlight 17 is disposed on a front region of the motorcycle. This motorcycle is so structured that the rear wheel 8 can be driven by the combustion engine E through a drive chain 11 and can be steered by the steering handlebar 4. In any event, the motorcycle of the structure so far described above may be of any known structure.

Figure 2:
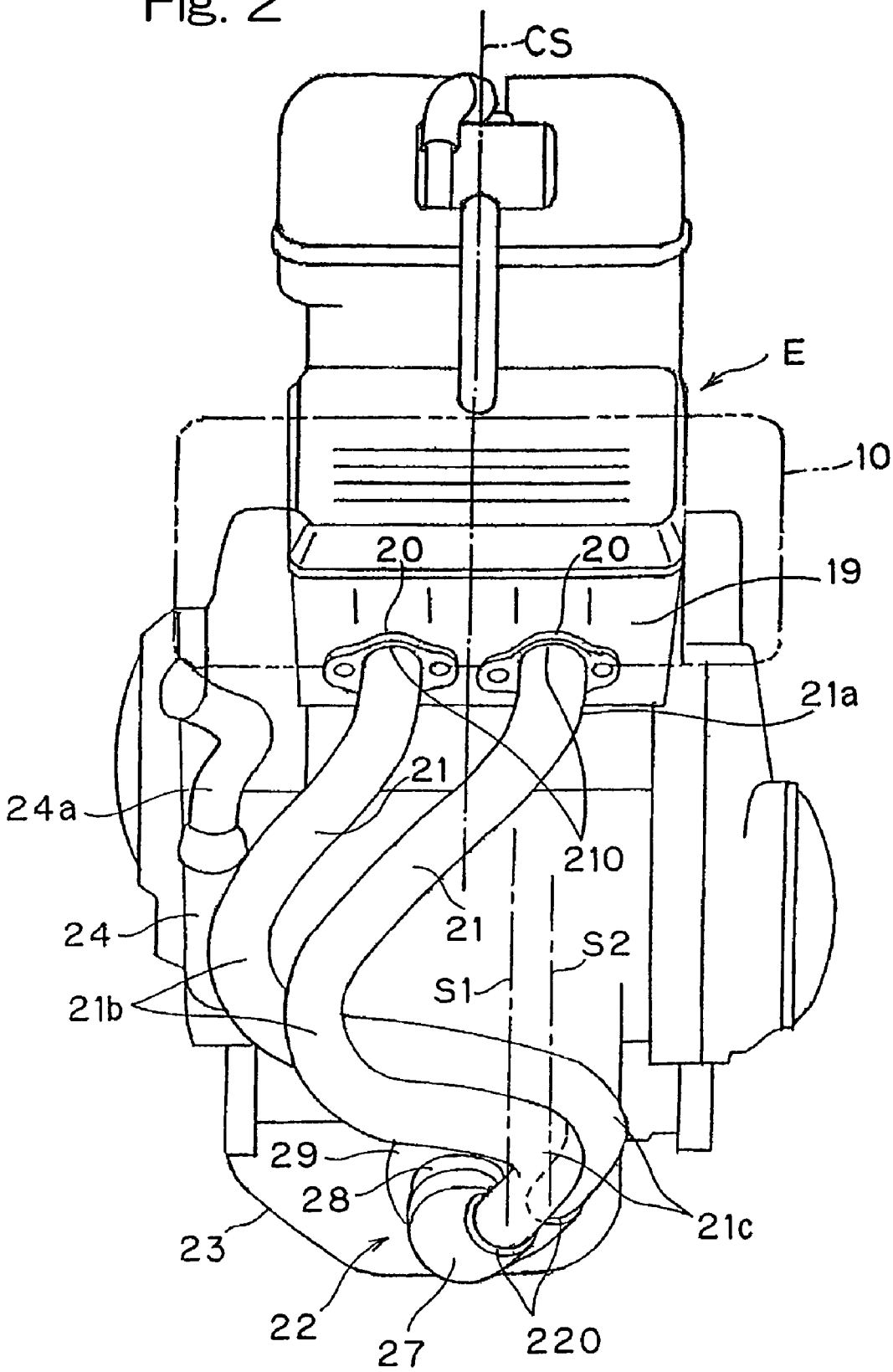
FIG. 2 is a front elevational view, on an enlarged scale, of a motorcycle engine fluidly connected with the exhaust system in accordance with the preferred embodiment shown in FIG. 1.

The motorcycle engine E is best shown in FIG. 2 in a front elevational representation. The motorcycle engine E includes a cylinder head 19 having a plurality of, for example, two in the illustrated embodiment, exhaust ports 20 defined therein, and respective exhaust tubes 21 are fluidly connected at an upstream end 210 with those exhaust ports 20. Downstream ends 220 of those exhaust tubes 21 are converged together by a manifold 22 which is in turn fluidly connected with a muffler (an exhaust silencing device) 23 best shown in FIG. 1. Each of the exhaust tubes 21 is in the form of a metallic tube formed by a metal tube bending process. The muffler 23 referred to above is positioned between a rear face of the motorcycle engine E and the rear wheel 8 and occupies a portion of the motorcycle frame structure substantially intermediate of the width thereof. The rear face of the engine E referred to previously is intended to encompass a rear face of a power plant including the engine E in its entirety, made up of the cylinder head 19 and a cylinder block, and a transmission.

Figure 3A:
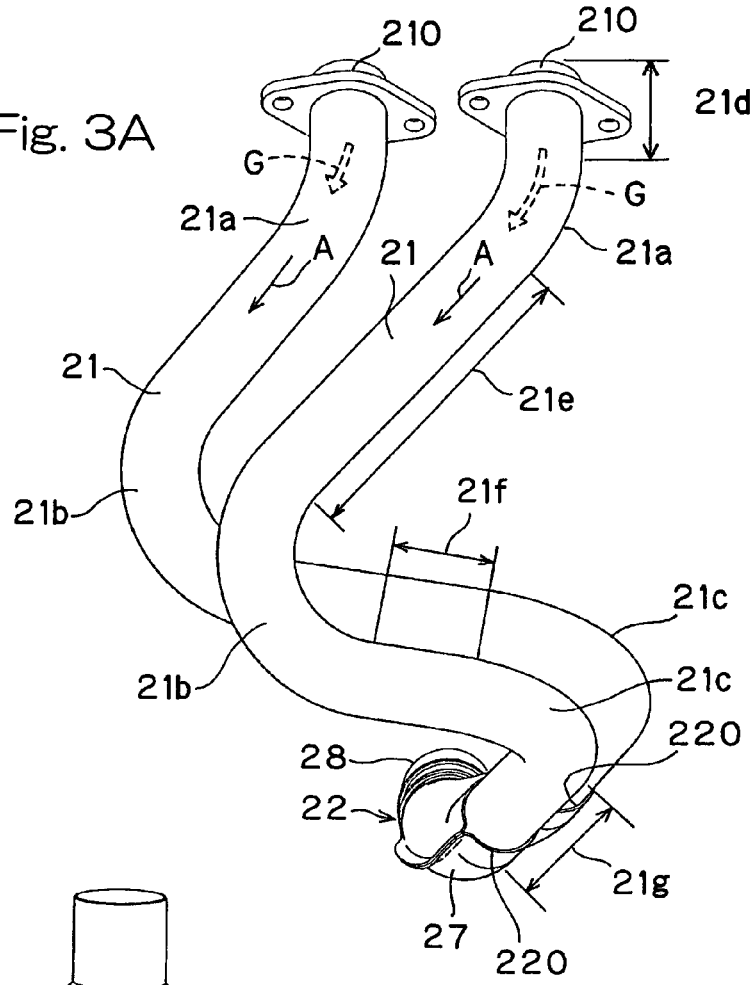
FIG. 3A is a front elevational view of the exhaust system shown in FIG. 1.
Figure 3B:
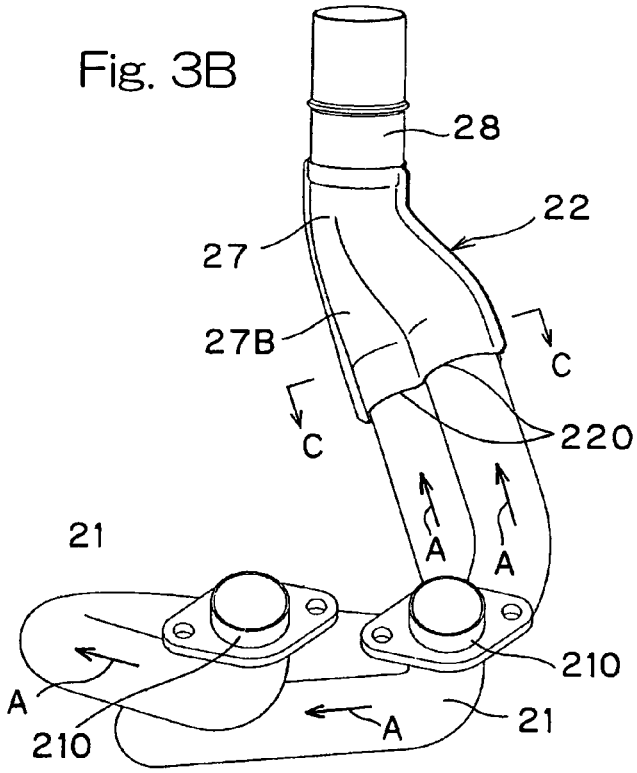
FIG. 3B is a plan view of the exhaust system shown in FIG. 1.

FIGS. 3A and 3B illustrates front elevational and plan views, respectively, showing the exhaust tubes 21 and the manifold 22. As best shown in FIG. 3A, each of the exhaust tubes 21, when viewed from front, represents a generally S-shaped configuration including first, second and third bent tube areas 21*a*, 21*b* and 21*c*, and each of those first to third bent tube areas 21*a* to 21*c* has upstream and downstream ends continued to first, second, third and fourth straight tube areas 21*d*, 21*e*, 21*f* and 21*g*, respectively. The respective upstream ends 210 and 210 of those exhaust tubes 21 and 21 are fluidly connected with the exhaust ports 20 and 20 of the engine E that are spaced a distance from each other in a direction widthwise of the engine E as shown in FIG. 2, whereas the respective downstream ends 220 and 220 of those exhaust tubes 21 and 21 are, after having been crossed over in position relative to the upstream ends 210 and 210, fluidly connected with the manifold 22. As viewed from front, substantially intermediate portions of those exhaust tubes 21 and 21 are crossed over in position relative to each other.

The first bent tube area 21*a* of each of the exhaust tubes 21 has a small bending angle and is continued to the first short straight tube area 21*d* that defines the respective upstream end 210. Each exhaust tube 21 is so configured as to extend downwardly from the first bent tube area 21*a* towards the second bent tube area 21*b* of a large bending angle through the relatively long second straight tube area 21*e* in a leftwardly slantwise direction as viewed from front and then to extend rightwards from the second bent tube area 21*b* through the third straight tube area 21*f* towards the third bent tube area 21*c* of a large bending angle, with which the respective exhaust tube 21 is again turned rearwardly at an intermediate location and then reach the downstream end 220 through the fourth straight tube area 21*g*. In other words, when viewed from front, each of the exhaust tubes 21 represents a generally S-shaped configuration including the second bent tube area 21*b*, which protrudes leftwards from the second and third straight tube areas 21*e* and 21*f* on respective upstream and downstream sides of such second bent tube area 21*b* with respect to the direction of flow A of the exhaust gases therethrough, and the third bent tube area 21*c*, which protrudes rightwards from the third and fourth straight tube areas 21*f* and 21*g* on respective upstream and downstream sides of such third bent tube area 21*c*.

Accordingly, as shown in FIG. 2, those exhaust tubes 21 extend generally tortuously so as to protrude leftwards and rightwards from associated reference planes S1 and S2 drawn from the respective downstream ends 220 of those exhaust tubes 21 in a vertical direction so as to extend parallel to each other in a forward and rearward direction, which reference planes S1 and S2 extend parallel to a vertically extending longitudinal center plane CS containing the longitudinal axis of the motorcycle. By so doing, the exhaust tubes 21 can have a large length from the upstream ends down to the downstream ends thereof within the limited permissible dimension.

In the motorcycle according to the illustrated embodiment, in order to reduce the total length of the exhaust system, including the exhaust tubes 21 and the muffler 23 as shown in FIG. 1, and also to increase the capacity of the exhaust system as a whole, the muffler 23 is positioned between the rear face of the motorcycle engine E and the rear wheel 8 to thereby reduce the space between the engine E and the muffler 23 as compared with that in the motorcycle in which the muffler is positioned laterally of the rear wheel 8. Accordingly, if the exhaust ports 20 and the muffler 23 were to be fluidly connected with each other through the conventional exhaust tubes that are so bent as to represent a generally L-shaped configuration, it would be difficult to design the exhaust tubes to have a length sufficient to secure a high exhaust efficiency by the use of an exhaust inertia. In view of this, the exhaust tubes 21 employed in the motorcycle embodying the present invention are so bent as to represent, when viewed from front, the generally S-shaped configuration including the first to third bent tube areas 21*a* to 21*c* as described hereinbefore with reference to FIG. 2.

With the foregoing design according to the present invention, the exhaust tubes 21 extend tortuously in a direction downwardly of the engine E, having meandered leftwards and rightwards of the body of the motorcycle and, therefore, the exhaust tubes 21 can have an increased total length without excessively protruding laterally outwardly of the body of the motorcycle. Therefore, not only can the required, excellent exhaust inertia be secured, but also the exhaust system as a whole can have a compact structure, in which the length of the exhaust tubes 21 including the muffler 23, as measured in a direction longitudinally of the motorcycle is small.

Also, the exhaust tubes 21 have respective intermediate portions, which are, when viewed from front, crossed over relative to each other and, consequently, the downstream ends 220 of those exhaust tubes 21 occupy their positions that are crossed over relative to the respective positions of the upstream ends 210 of those exhaust tubes 21. Therefore, while the exhaust tubes 21 have the three bent tube areas 21*a* to 21*c* that are bent in such a large radius of curvature as to allow the exhaust gases to smoothly flow through those exhaust tubes 21, the two exhaust tubes 21 can be easily and readily designed to have the same length.

In addition, since the exhaust tubes 21 are of a shape including the straight tube areas 21*d* to 21*g* each positioned on an upstream or downstream side of the neighboring bent tube area 21*a* to 21*c* with respect to the direction of flow of the exhaust gases towards the atmosphere, the exhaust tubes 21 can easily be manufactured with each of the bent tube areas 21*a* to 21*c* bent accurately to a predetermined curvature. Specifically, each of the exhaust tubes 21 can easily be manufactured by pressing a bending roller against a portion of a straight tube, which corresponds in position to each bent tube area 21*a* to 21*c*, while it is gripped from opposite sides with a pair of chucking members of a bending machine.

As shown in FIG. 2, the exhaust tubes 21 are so arranged as to detour a water tube 24*a* positioned on a left side of the engine E and forming a discharge passage of a water pump 24 for engine cooling water.

It is to be noted that in describing the foregoing embodiment, reference has been made to the use of the two exhaust tubes 21, the present invention can be equally applicable to a motorcycle engine having one or three or more exhaust ports. By way of example, if the single exhaust tube in the case of the motorcycle engine having the only exhaust port or the three or more exhaust tubes in the case of the motorcycle engine having the three or more exhaust ports is/are so shaped as to have three or more bent tube areas 21*a* to 21*c* that are bent when viewed from front, effects similar to those described hereinabove can be obtained. Also, where the motorcycle engine has a plurality of pairs of exhaust tubes 21, it is preferred that each pair of the exhaust tubes be crossed over relative to each other at respective intermediate portions thereof in a manner similar to that described hereinbefore.

Figure 4:
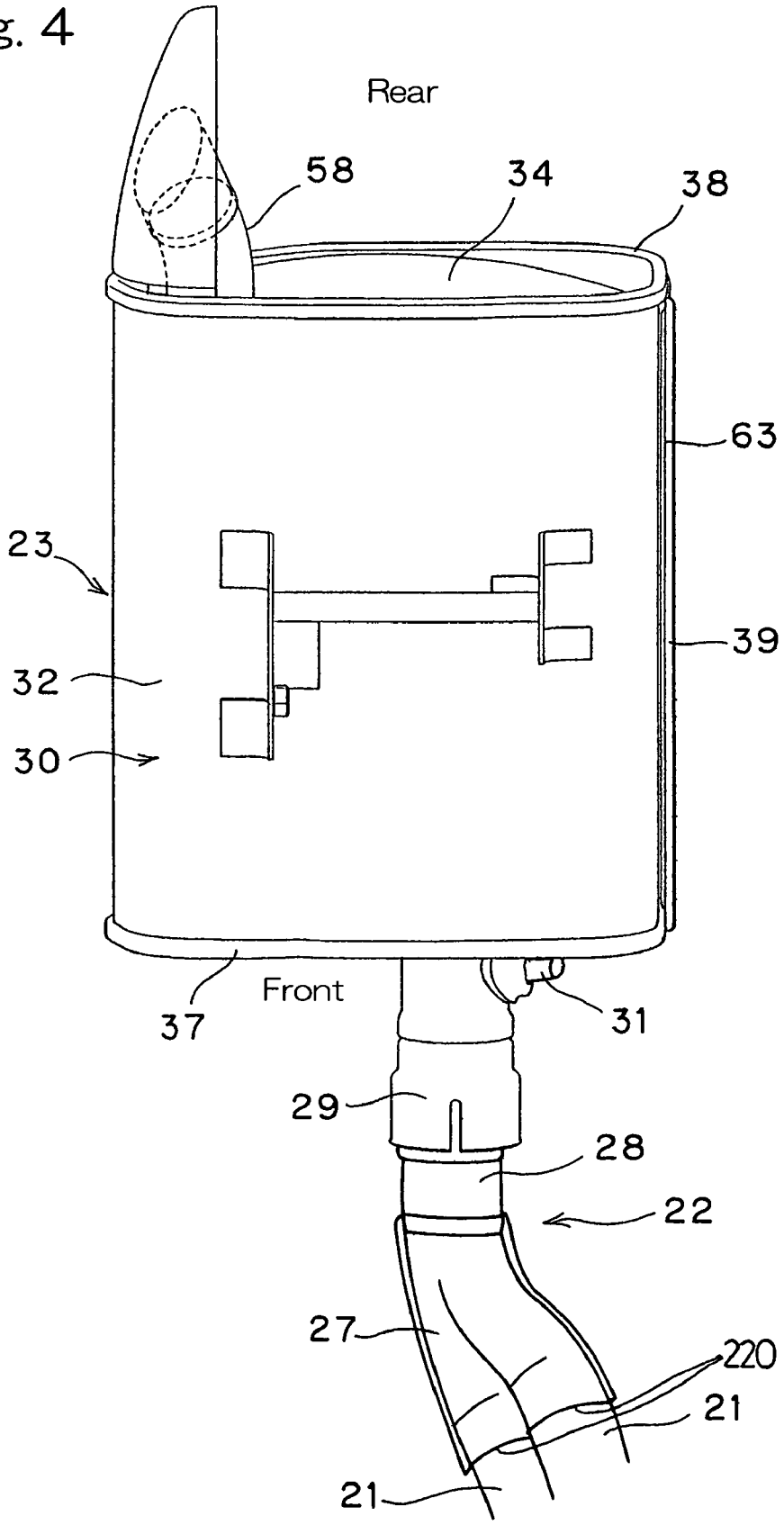
FIG. 4 is a plan view of a muffler forming a part of the exhaust system shown in FIG. 1.

FIG. 4 illustrates a plan view showing the muffler 23 and the manifold 22. The manifold 22 is of a structure designed to fluidly connect the respective downstream ends 220 of the exhaust tubes 21 to a coupling tube 28 through a collecting-connecting tube 27. The coupling tube 28 has a rear end fluidly connected with an inlet tube 29, through which the exhaust gases flowing through the exhaust tubes 21 can be introduced into the interior of the muffler 23. This inlet tube 29 is fixed to a muffler casing 30 so as to protrude forwardly therefrom and forms a part of an exhaust introducing passage through which the exhaust gases are introduced into an expansion chamber defined within the muffler 23 as will be described in detail later. This inlet tube 29 has an exhaust composition detecting sensor 31 disposed therein for detecting the content of oxygen contained in the exhaust gases introduced into the inlet tube 29.

Figure 3C:
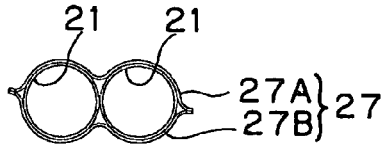
FIG. 3C is a cross-sectional view taken along the line C-C in FIG. 3B.

It is to be noted that as shown in FIG. 3C showing a cross-sectional view taken along the line C-C in FIG. 3B, the collecting-connecting tube 27 is of a structure, in which first and second bifurcated coupling tube halves 27A and 27B each having opposite ends formed with respective coupling flanges are butted together with the coupling flanges of those tube halves 27A and 27B welded together.

Figure 5:
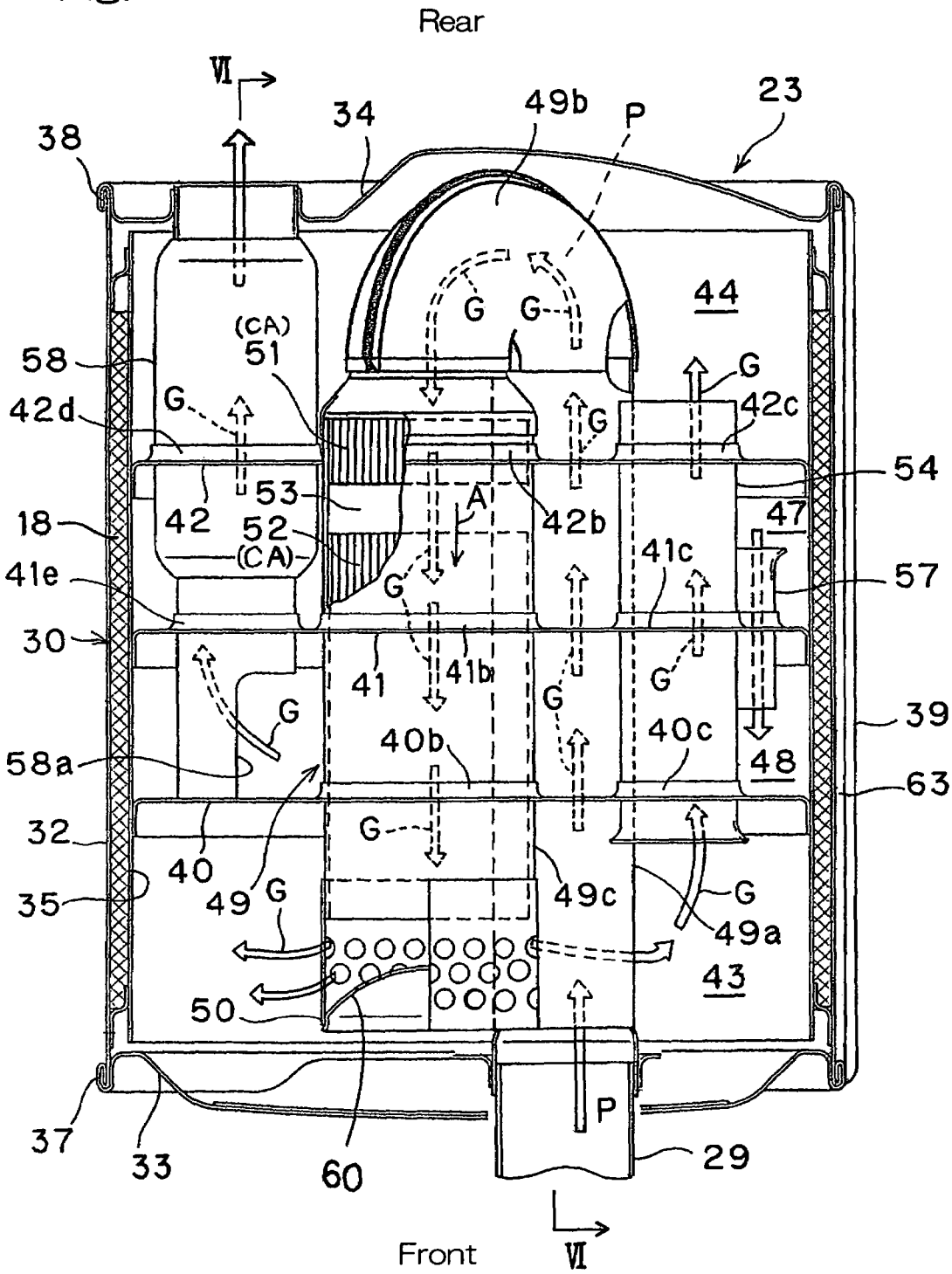
FIG. 5 is a longitudinal sectional view of the muffler shown in FIG. 4.
Figure 6:
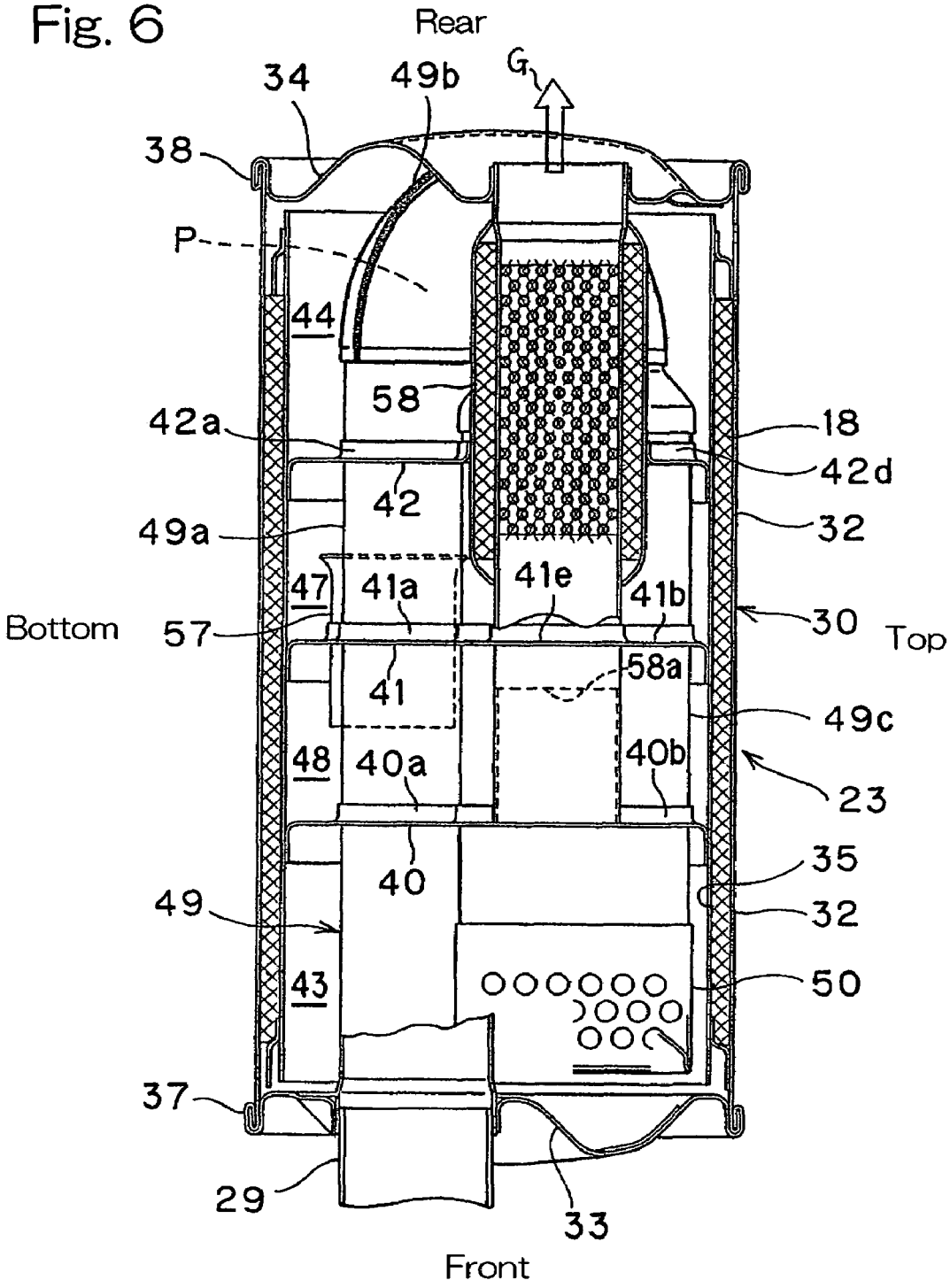
FIG. 6 is a cross-sectional view taken along the line VI-VI in FIG. 5.

The muffler 23 referred to above is shown in a longitudinal sectional representation in FIG. 5, and a cross-section of the muffler 23 taken along the line VI-VI in FIG. 5 is shown in FIG. 6. The muffler casing 30 includes an open-ended tubular body 32 having front and rear ends opening, a front end plate 33 closing the front open end of the tubular body 32 and a rear end plate 34 closing the rear open end of the tubular body 32. The tubular body 32 has front and rear flanges formed integrally with front and rear ends thereof, which are curled as at 37 and 38 to crimp respective outer peripheral edges of the front and rear end plates 33 and 34 to thereby sealingly connect the latter to the tubular body 32. The front and rear flanged portions 37 and 38, where the front and rear end plates 33 and 34 are connected to the tubular body 32 so as to close the front and rear open ends of the latter, respectively, protrude laterally outwardly form the outer peripheral surface of the tubular body 32, and a muffler side cover 39, which defines a muffler cover, is welded at front and rear ends to respective right side portions of outer peripheries of the associated flanged portions 37 and 38. The details of the muffler side cover 39 will be described in detail later.

The tubular body 32 is of a substantially double shelled construction including an inner tube 35 positioned inside the tubular body 32 with a space between it and the inner tube 35 filled up with glass wool 18, to thereby enhance the effect of silencing noises generated by the flow of exhaust gases G. The tubular body 32, front and rear end plates 33 and 34 and inner tube 35 of the muffler casing 30 are all made of a metallic plate such as, for example, stainless steel plate.

The interior of the muffler casing 30 is divided into first, second, third and fourth expansion chambers 43, 44, 47 and 48 by means of three partition walls 40, 41 and 42 each having its outer peripheral edge solidly fixed to the inner peripheral surface of the inner tube 35. The first to fourth expansion chambers 43, 44, 47 and 48 are fluidly connected in this order with respect to the direction of flow of the exhaust gases. The first expansion chamber 43 defines the uppermost stream chamber and does hence occupy the foremost portion of the interior of the muffler casing 30, whereas the second expansion chamber 44 defines the lower stream chamber of the first expansion chamber 44 and does occupy the rearmost portion of the interior of the muffler casing 30, with the third and fourth expansion chambers 47 and 48 defined adjacent to the second expansion chamber 44 and the first expansion chamber 43, respectively.

The muffler casing 30 also includes an exhaust introducing tube 49 disposed within the interior thereof for introducing the exhaust gases G into the muffler casing 30. This exhaust introducing tube 49 extends completely through and is supported by the three partition plates 40, 41 and 42 and has an upstream end fluidly connected with the inlet tube 29 supported by the front end plate 33 of the muffler casing 30, to thereby define an exhaust introducing passage P through which the exhaust gases G can be introduced into the first expansion chamber 43 defined in the front end portion of the muffler casing 30.

More specifically, the exhaust introducing passage P is defined by the inlet tube 29, extending completely through and fixedly supported by the front end plate 33 of the muffler casing 30, and the exhaust introducing tube 49. The exhaust introducing tube 49 referred to above is one of exhaust guide tubes for introducing the exhaust gases G into the expansion chambers. This exhaust introducing tube 49 includes an upstream tube portion 49*a* extending from its upstream end, which is fluidly connected with the inlet tube 29, towards a portion adjacent the rear end plate 34 of the muffler casing 30 after having successively passed completely through the partition plates 40 to 42; a substantially U-shaped turnback tube portion 49*b* fluidly connected with a downstream end of the upstream tube portion 49*a* for directing the exhaust gases G flowing in one direction through the upstream tube portion 49*a* to flow in a direction counter to such one direction towards a front region of the muffler casing 30; and a downstream tube portion 49*c* fluidly connected with a downstream end of the turnback tube portion 49*b* and extending therefrom towards the front end plate 33.

The upstream tube portion 49*a*, the turnback tube portion 49*b* and the downstream tube portion 49*c* of the exhaust introducing tube 49 has a round cross-section to allow the exhaust introducing passage P of a round sectional shape. As best shown in FIG. 6, the upstream tube portion 49*a* is positioned below the downstream tube portion 49*c* to thereby restrict the width of the exhaust introducing tube 49 as measured in a horizontal direction.

Referring again to FIG. 5, the downstream tube portion 49*c* has a downstream end extending into the first expansion chamber 43 at the front end portion of the muffler casing 30 and fluidly connected with an exhaust buffer 50 operable to introduce the exhaust gases G into the first expansion chamber 43 while attenuating energies of the exhaust gases G by the utilization of an interference effect. The details of this exhaust buffer 50 will be described in detail later.

The downstream tube portion 49*c* of the exhaust introducing tube 49 is provided with a catalytic converter assembly CA therein disposed at a location between the generally U-shaped turnback passage portion 49*b* and the first expansion chamber 43. The catalytic converter assembly CA includes a first or upstream catalytic converter 51 and a second or downstream catalytic converter 52 disposed, having been spaced from each other in a direction conforming to the direction of flow of the exhaust gases C, with a gap 53 defined therebetween. In the illustrated embodiment, any known honeycomb-type catalytic converter is employed for each of the first and second catalytic converter 51 and 52. Each of those honeycomb-type catalytic converters 51 and 52 includes a monolithic catalyst carrier made of ceramic material and having a multiplicity of honeycomb pores, which is coated with alumina and also with Pt or Pd as oxidization catalyst and Rh as reduction catalyst coated over the alumina layer. It is, however, to be noted that in place of the honeycomb type, a pipe type catalytic converter may be employed, which is of a structure including a punched pipe having its entire surface coated with catalyst.

Figure 7:
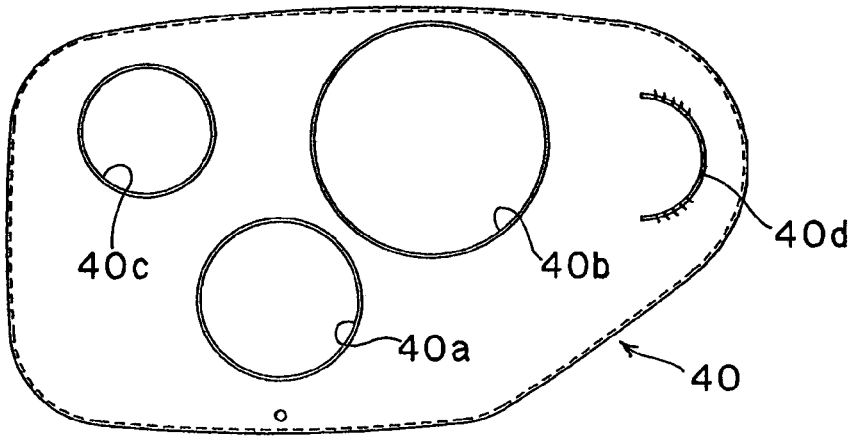
FIG. 7 is a rear view of a first partition plate disposed within the muffler shown in FIG. 4.
Figure 8:
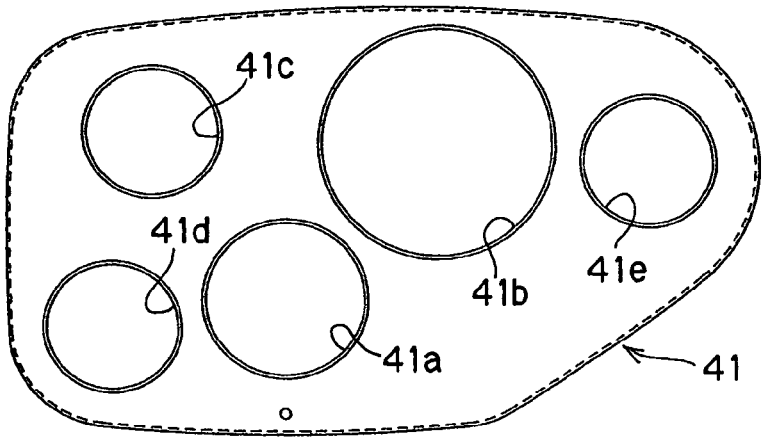
FIG. 8 is a rear view of a second partition plate disposed within the muffler shown in FIG. 4.
Figure 9:
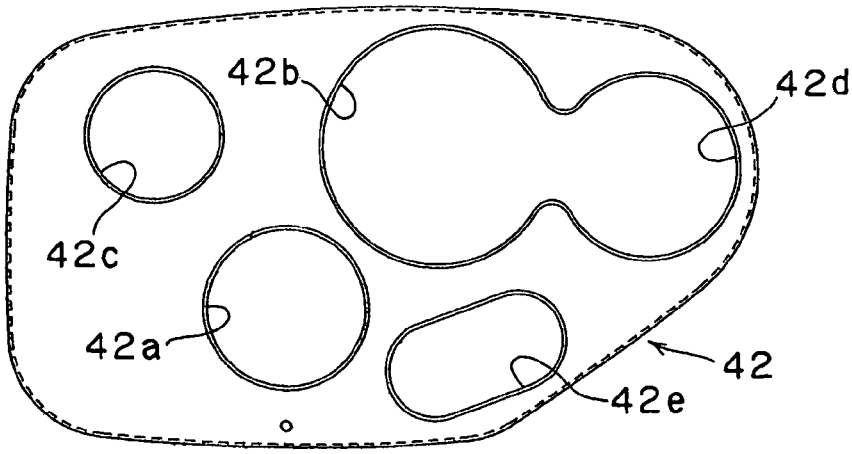
FIG. 9 is a rear view of a third partition plate disposed within the muffler shown in FIG. 4.

The first to third partition plates 40 to 42 referred to above are shown in a rear view in FIGS. 7 to 9, respectively. As shown therein, each of the first to third partition plates 40 to 42 has a first flanged support opening 40*a*, 41*a* or 42*a*, which is defined therein at a lower center portion of the respective partition plate 40, 41 or 42 and through which the upstream tube portion 49*a* (FIG. 5) of the exhaust introducing tube 49 extends and is fixedly supported, and a second flanged support opening 40*b*, 41*b* or 42*b*, which is defined therein at an upper center portion of the respective partition plate 40, 41 or 42 and through which the downstream tube portion 49*c* (FIG. 5) of the exhaust introducing tube 49 extends and is fixedly supported. As best shown in FIG. 5, a peripheral lip region of each of those flanged support openings 40*a*, 41*a*, 42*a*, 40*b*, 41*b* and 42*b* is, when the respective flanged support opening 40*a*, 41*a*, 42*a*, 40*b*, 41*b* and 42*b* is defined in the corresponding partition plate 40, 41 and 42, pressed to raise axially outwardly to define a support flange and, therefore, the exhaust tube 40 inserted through the associated flanged support opening 40*a*, 41*a*, 42*a*, 40*b*, 41*b* or 42*b* can be stably supported by the respective partition plate 40, 41 or 42.

Also, each of the first to third partition plates 40 to 42 also has a third flanged support opening 40*c*, 41*c* or 42*c* defined therein at a location upwardly of the corresponding first flanged support opening 40*a*, 41*a* or 42*a* and laterally of the corresponding second flanged support opening 40*b*, 41*b* or 42*b*. As is the case with each of the first and second flanged support openings 40*a*, 41*a*, 42*a* and 40*b*, 41*b*, 42*b*, a peripheral lip region of each of those flanged support openings 40*c*, 41*c* and 42*c* is, when the respective flanged support opening 40*c*, 41*c* and 42*c* is defined in the corresponding partition plate 40, 41 and 42, pressed to raise axially outwardly to define a support flange. Extending through and fixedly supported by those third flanged support openings 40*c*, 41*c* and 42*c* is a first communicating tube 54 shown in a right portion of FIG. 5, which tube 54 defines a communicating passage through which the first expansion chamber 43 in the front end portion of the muffler casing 30 is communicated with the second expansion chamber 44 in the rear end portion of the muffler casing 30.

The third partition plate 42 defining the second expansion chamber 44 within the muffler casing 30 in cooperation with the rear end plate 34 is, as best shown in FIG. 9, formed with a communicating hole 42*e* defined therein at a location below the second flanged support opening 42*b*, through which hole 42*e* the second expansion chamber 44 shown in FIG. 5 is communicated with the third expansion chamber 47 also shown in FIG. 5.

As best shown in FIG. 8, the second partition plate 41 intermediate between the first and third partition plates 40 and 42 has a fourth flanged support opening 41*d* defined therein at a location laterally of the first flanged support opening 41*a* and also has a fifth flanged support opening 41*e* defined therein at a location on one side of the second flanged support opening 41*b* remote from the third flanged support opening 41*c*. This fourth flanged support opening 41*d* receives therein a second communicating tube 57 which defines a communicating passage for communicating the third expansion chamber 47 with the fourth expansion chamber 48 as shown in FIG. 6.

Also, as best shown in FIG. 9, the third partition plate 42 in the rearmost area of the muffler casing 32 has a fourth flanged support opening 42*d* defined therein in communication with the second flanged support opening 42*b*. A tail tube 58 extends through and is fixedly supported by the fourth flanged support opening 42*d* in the third partition plate 42 and the fifth flanged support opening 41*e* in the second partition plate 41 as shown in FIG. 5. An upstream of this tail tube 58 has one of peripheral halves or, semicircular portion thereof cut out to define an exhaust intake opening 58*a*, whereas a downstream end of this tail tube 58 extends completely through and fixedly supported by the rear end plate 34 of the muffler casing 30. Accordingly, the tail tube 58 serves to receive the exhaust gases G within the fourth expansion chamber 48, positioned downstream with respect to the flow of the exhaust gases G, through the exhaust intake opening 58*a* and then to discharge them to the outside of the muffler casing 30. The other of the halves of the upstream end of the tail tube 58, which represents a generally semicircular shape left by the formation of the exhaust intake opening 58*a*, is, while held in engagement in a correspondingly shaped welding slit 40*d* (FIG. 7). defined in the first partition wall 40, welded rigidly to the first partition wall 40 through the welding slit 40*d*.

The muffler 23 shown in FIG. 5 includes catalytic converter assembly CA having the first and second catalytic converters 51 and 52 incorporated within the downstream tube portion 49*c* of the exhaust introducing tube 49, to thereby form an catalytic converter-equipped exhaust silencing device, which functions in the following manner.

Assuming that the exhaust gases G are introduced from the motorcycle engine E into the muffler 23 through the exhaust tubes 21 and then through the collecting and connecting tube 27, the exhaust gases G flows into the exhaust introducing tube 49 inside the muffler 23 through the inlet tube 29 shown in FIG. 5 and are subsequently guided from a front end portion towards a rear end portion of the muffler 23 through the upstream tube portion 49*a* of the exhaust introducing tube 49. The exhaust gases G so guided are turned backwards through the turnback tube portion 49*b* so as to flow towards the front end portion of the muffler 23. Thereafter, the exhaust gases G are introduced into the first catalytic converter 51 within the downstream tube portion 49*c* so that obnoxious unburned components of the exhaust gases G such as, for example, HC and CO can be removed by the well known oxidization taking place in the first catalytic converter 51. The exhaust gases G having passed through a number of small passages in the first catalytic converter 51 flow into and mixed up within the gap 53 so that the flow of the exhaust gases G can be equalized by location. It is, however, to be noted that if the exhaust gases were passed through a long catalytic converter without this gap 53 employed, the exhaust gases will flow biased by the effect of a centrifugal force developed during the flow thereof through the turnback tube portion 49*b* and, as a result, it may occur that only a portion of the first catalytic converter 51 is utilized resulting in no effective purification of the exhaust gases.

The exhaust gases G, which have been substantially purified to a certain extend as they flow through the first catalytic converter 51, subsequently flow through the second catalytic converter 52, where they are further purified substantially, and then flow through the exhaust buffer 50 into the first expansion chamber 43, where they are expanded. The exhaust gases G emerging outwardly from the first expansion chamber 43 flow into the first communicating tube 54, where they are contracted, and then into the second expansion chamber 44, where they are again expanded. Thereafter, the exhaust gases G emerging outwardly from the second expansion chamber 44 flow into the third expansion chamber 47 through the communicating hole 42*e* (FIG. 9) in the third partition plate 42 and then into the second communicating tube 57, where they are again contracted before they flow into the fourth expansion chamber 48. The exhaust gases G entering the fourth expansion chamber 48 are once more expanded within such fourth expansion chamber 48. On the other hand, the exhaust gases G introduced into the fourth expansion chamber 48 are, after having flowed into the tail tube 58 through the exhaust intake opening 58*a*, discharged from the tail tube 58 to the outside of the muffler 23.

Alternate contraction and expansion (and, hence, alternate deceleration and acceleration) of the exhaust gases G that take place as they flow from the first expansion chamber 43 to the fourth expansion chamber 48 through the exhaust introducing tube 49 are effective to allow the exhaust gases G to dissipate their energies to thereby reduce exhaust noises sufficiently. In this way, a desired silencing effect can be secured.

If in the muffler 23 of the structure described above, the total quantity of oxygen contained in the exhaust gases G could be burned together with the unburned components of the exhaust gases as they flow successively through the first and second catalytic converters 51 and 52, the exhaust gases G could be purified to such an extent that they may hardly contain HC and CO components and the optimum purifying performance could therefore be obtained. For this purpose, it is necessary to control the exhaust gases G, discharged from the motorcycle engine E, so as to contain a predetermined or required quantity of oxygen and this may preferably be accomplished by causing a fuel supply control device (not shown) for supplying fuel towards the engine E to control the air/fuel mixing ratio to attain a value about equal to the stoichiometric air/fuel mixing ratio of 14.8 to thereby allow the exhaust gases G to contain the predetermined or required quantity of oxygen.

In view of the foregoing, the muffler 23 makes use of the exhaust composition detecting sensor 31 disposed in the inlet tube 29 so that the quantity of oxygen contained in the exhaust gases G flowing towards the muffler 23 can be detected before they are introduced into the muffler 23, that is, they flow through the first and second catalytic converters 51 and 52. A detection signal outputted from the exhaust composition detecting sensor 31, which is indicative of the quantity of oxygen contained in the exhaust gases G, is then utilized by the fuel supply control device, which performs a feedback control of the quantity of fuel to be supplied towards the engine E in such a way as to control the intake air-fuel mixture to have an air/fuel mixing ratio about equal to the stoichiometric value of 14.8. Accordingly, the quantity of oxygen contained in the exhaust gases G before they are introduced into the first and second catalytic converters 51 and 52 can be controlled accurately and, therefore, the first and second catalytic converters 51 and 52 can exhibit the purifying performance to the maximum limit with the obnoxious components such as, for example, HC and CO in the exhaust gases G removed effectively.

In contrast thereto, since in the prior art, the quantity of oxygen contained in the exhaust gases that have entered the expansion chamber and then expanded is detected, oxygen remaining within the expansion chamber and oxygen contained in the subsequently introduced exhaust gases are mixed together and, therefore, the quantity of oxygen contained in the exhaust gases just discharged from the engine cannot be accurately detected. Under these circumstances, the feedback control performed by the fuel supply control device has a less response and therefore, it may occur that the exhaust gases flowing through the catalytic converter cannot be purified sufficiently.

Also, with the muffler 23 in the form of the catalytic converter-incorporated exhaust silencing device, the exhaust gases G are, prior to being introduced successively through the expansion chambers 43, 44, 47 and 48, passed successively through the first and second catalytic converters 51 and 52, both disposed inside the exhaust introducing tube 49, to thereby substantially purify the exhaust gases G and, therefore, it is possible to effectively purify the substantially total quantity of the exhaust gases G introduced into the muffler 23.

In contrast thereto, with the conventional catalytic converter-incorporated exhaust silencing device, the exhaust gases flowing from the discharge tubes are first supplied into the expansion chamber to allow them to be expanded to thereby suppress pulsation of the exhaust gases and also to reduce the velocity of flow of the exhaust gases, so as to reduce the resistance which would occur when the exhaust gases are passed through the catalytic converter. Accordingly, the exhaust gases expanded within the expansion chamber will, even though the flow velocity thereof is reduced, have a pressure increased as a result of expansion, and a portion of the exhaust gases may leak outwardly through a gap between the partition wall defining the expansion chamber and the muffler casing. Once this occurs, the total amount of the exhaust gases cannot be passed through the catalytic converter and, hence, the exhaust purifying performance is consequently lowered.

In addition, in the muffler 23 of the structure described above, the exhaust gases G are, after having been guided from the front end portion of the muffler 23 to the rear end portion thereof through the upstream tube portion 49*a* of the exhaust introducing tube 49, turned backwards by the turnback tube portion 49*b* so as to flow into the first expansion chamber 43 within the muffler casing 30 through the downstream tube portion 49*c*, then flow from the first expansion chamber 43 towards the second expansion chamber 44 through the first communicating tube 54, and finally flow from the second expansion chamber 44 towards the tail tube 58 successively through the third and fourth expansion chambers 47 and 48 before they are discharged from the tail tube 58 to the outside of the muffler casing 30. Accordingly, before the exhaust gases G are introduced into the first expansion chamber 43, those exhaust gases G makes approximately one round trip from the inlet tube 29 to the rear end portion of the muffler casing 30 by way of the exhaust introducing tube 49 and, consequently, the exhaust passage through which the exhaust gases flow before being expanded can have an increased length. Hence, by the utilization of the exhaust inertia brought about by the pulsating flow of the exhaust gases G, the exhausting efficiency can be increased.

Also, since in this muffler 23, the first and second catalytic converters 51 and 52 are disposed inside the exhaust introducing tube 49 within the muffler casing 30, the first and second catalytic converters 51 and 52 can be kept warm or heated. Consequently, activation of the catalyst employed in each of the first and second catalytic converters 51 and 52 immediately after the start of the motorcycle engine can be enhanced, accompanied by increase of the exhaust purifying performance.

Figure 10:
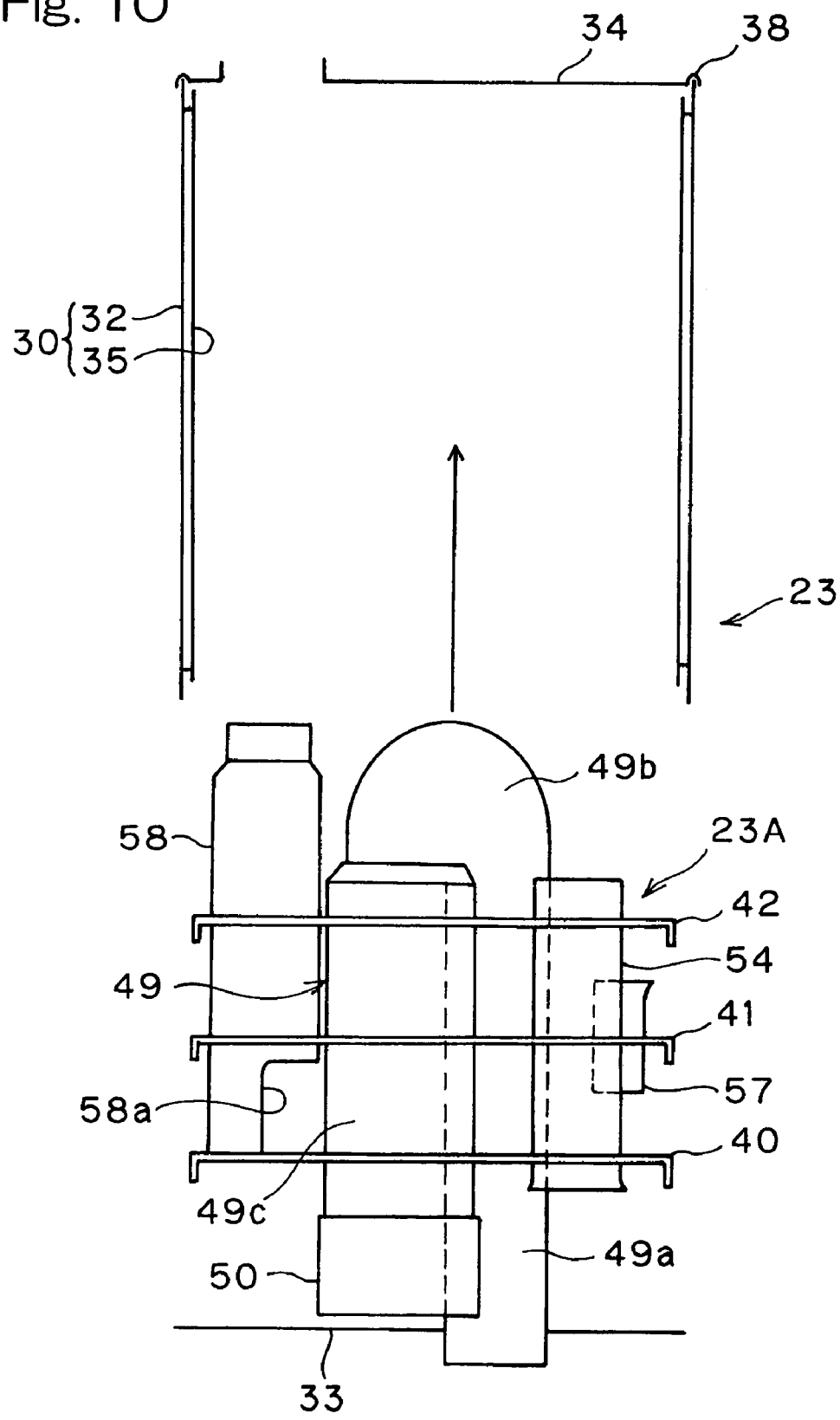
FIG. 10 is a schematic diagram showing the manner of making the muffler shown in FIG. 4.

The muffler 23 of the structure described above can be manufactured by the following manner with particular reference to FIG. 10. As shown therein. in the first place, the rear end plate 34 is secured to the rear end portion of the tubular body 32 of the muffler casing 30 by means of the staking or crimping technique in the manner described hereinbefore. On the other hand, the exhaust introducing tube 49, the first and second communication tubes 54 and 57 and the tail tube 58 are passed through the associated flanged support openings 40*a* to 40*c*, 41*a* to 41*e*, 42*a* to 42*d* (See FIGS. 7 to 9.), with the flanges of the peripheral lip regions of those openings welded to the tubes 49, 54 and 57 and 58 to thereby cause the first to third partition plates 40 to 42 to rigidly support the tubes 49, 54 and 57 and 58 and the inlet tube 29 inserted so as to extend through the front end plate 33 is also welded together with the front end plate 33, thereby completing a muffler assembly 23A.

The muffler assembly 23A so formed is inserted into the tubular body 32 from a front opening of the tubular body 32 of the muffler casing 30 in a direction shown by the arrow so that the muffler assembly 23A can assume a predetermined position inside the muffler casing 30 and, on the other hand, a discharge end of the tail tube 58 is welded to the rear end plate 34, followed by crimping the front end plate 33 to a front end portion of the tubular body 32, thereby completing the muffler 23. Since at this time the generally semicircular upstream end of the tail tube 58 adjacent the exhaust intake opening 58*a* is rigidly welded to the first partition plate 40 in the manner as hereinbefore described, the first partition plate 40 can be reinforced and an undesirable deformation of the first partition plate 40, which would otherwise occur as a result of a frictional force developed between it and the inner surface of the inner tube 35 during the insertion, can advantageously be avoided.

It is to be noted that although in describing the foregoing embodiment, the exhaust composition detecting sensor 31 (FIG. 4) has been shown and described as provided in the inlet tube 29, it may be positioned at any location, provided that such location is upstream of the catalytic converters 51 and 52 with respect to the direction of flow of the exhaust gases. Even in such case, effects similar to those afforded by the foregoing embodiment can be equally obtained. It is also to be noted that although in the foregoing embodiment, reference has been made to the use of the two catalytic converters 51 and 52, the present invention may not be always limited thereto and a single catalytic converter may therefore be employed rather than the two catalytic converters.

Figure 11:
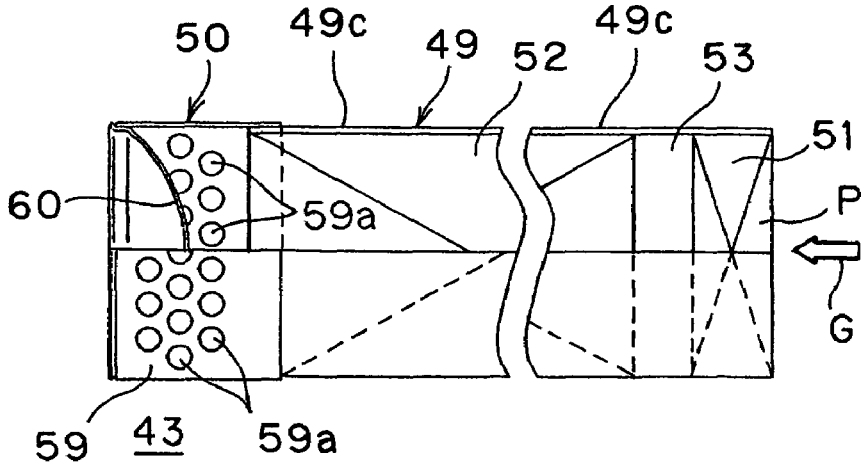
FIG. 11 is a side sectional view, with a portion cut out, showing an exhaust buffer defined within the muffler shown in FIG. 4.

The exhaust buffer 50 referred to previously is rigidly mounted on a downstream end of the downstream tube portion 49*c* of the exhaust introducing tube 49. This is specifically shown in FIG. 11. Referring to this figure, this exhaust buffer 50 includes a cylindrical wall 59, forming a part of the outer periphery of the exhaust introducing passage P in cooperation with the exhaust introducing tube 49, and a passage end wall 60 defining a terminal wall of the exhaust introducing passage P. The passage end wall 60 is of a generally spherical shape smoothly curved to protrude in a direction upstream of the exhaust introducing passage P and is fixedly inserted into a downstream end portion of the cylindrical wall 59 so as to close a downstream opening of the cylindrical wall 59. This cylindrical wall 59 has a multiplicity of flow-out perforations 59*a* defined in the entire peripheral surface thereof uniformly in a predetermined pattern for the discharge of exhaust gases G therethrough into the expansion chamber 43 and has its outer peripheral surface inserted and then welded fixedly to the downstream end of the downstream tube portion 49*c*.

As best shown in FIG. 5, the downstream tube portion 49*c* of the exhaust introducing tube 49 provided with the exhaust buffer 50 as described above is supported in a cantilever fashion with a portion thereof adjacent the downstream end thereof fixedly supported by the first partition wall 40. In this condition, the exhaust gases G having passed successively through the first and second catalytic converters 51 and 52 and hence elevated to a high temperature, accompanied by high energies, flow through the exhaust buffer 50 and, accordingly, the exhaust buffer 50 is susceptible to vibration. However, since in the illustrated embodiment, the passage end wall 60 of the exhaust buffer 50 is of the spherical shape protruding inwardly as described above, the passage end wall 60 can smoothly guide the exhaust gases G with a low resistance therealong in a direction laterally thereof and, therefore, vibrations of the downstream end portion of the downstream tube portion 49*c* and the exhaust buffer 50, which are caused by the flow of the exhaust gases G therethrough, can advantageously be suppressed.

Also, the exhaust buffer 50 is operable to allow the exhaust gases G to uniformly flow into and expand inside the first expansion chamber 43 through the multiplicity of the flow-out perforations 59*a* defined in the cylindrical wall 59 and, yet, the exhaust buffer 50 of the structure described can bring about such an effect that when the exhaust gases G are allowed to flow through the multiplicity of the flow-out perforations 59*a*, the exhaust noises caused by the flow of the exhaust gases G can be reduced to a less offensive sound.

It is to be noted that the exhaust buffer 50 referred to above may be fitted to a downstream end of each of the first and second communicating tubes 54 and 57, which are exhaust introducing tubes. Even in this case, effects similar to those afforded when the exhaust buffer 50 is fitted to the downstream end of the downstream tube portion 49*c* can be equally obtained. It is also to be noted that the passage end wall 60 of the exhaust buffer 50 may not be always of the spherical shape, but may be of a conical shape, or of a quadrangular pyramidal shape if the communicating tubes 54 and 57 have a substantially square sectional shape. Yet, the passage end wall 60 may be so shaped and so configured as to protrude in a direction downstream of the exhaust introducing tube 49, in which case vibrations brought about by the flow of exhaust gases G can be avoided although no effect of smoothly guiding the exhaust gases G in a lateral direction can be obtained.

Figure 12:
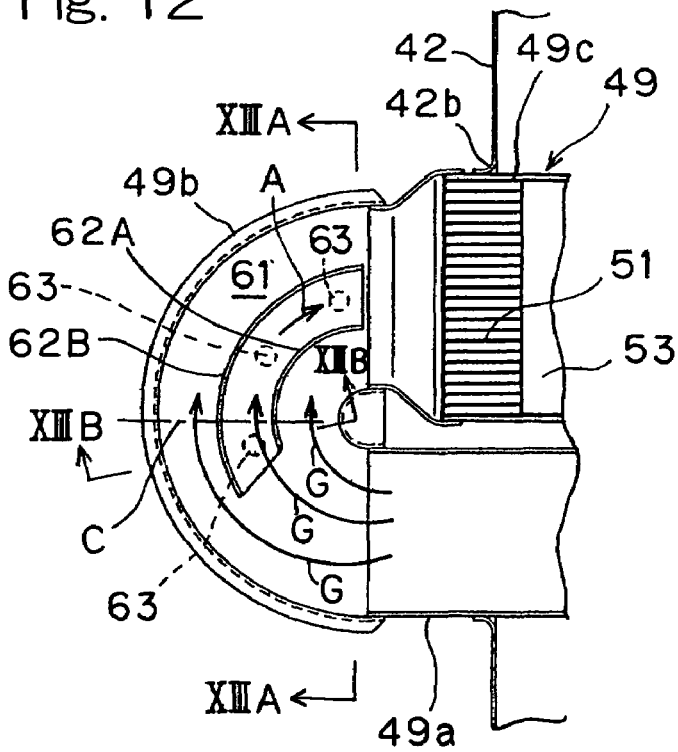
FIG. 12 is a fragmentary longitudinal sectional view showing a rectifying plate disposed at an inlet to a catalytic converter, which forms a part of an exhaust introducing passage disposed within the muffler shown in FIG. 4.

Referring now to FIG. 12, the turnback tube portion 49*b* of the exhaust introducing tube 49 has a converter inlet passage 61 defined therein for introducing the exhaust gases G towards the first catalytic converter 51. This converter inlet passage 61 includes first and second curved rectifying plates 62A and 62B disposed therein for preventing the flow of the exhaust gases G therethrough from being biased or displaced in one direction within the exhaust inlet passage 61. Each of those first and second rectifying plates 61A and 61B is so curved as to follows the curvature of the turnback tube portion 49*b* and extend in a direction conforming to the direction of flow A of the exhaust gases G within the turnback tube portion 49*b*.

In the turnback tube portion 49*b*, there is a tendency that the quantity of the exhaust gases G flowing in an outer region of the converter inlet passage 61 is larger than that flowing in an inner region of the same inlet passage 61 under the influence of a centrifugal force developed by the flow of the exhaust gases G. If the rectifying plates 62A and 62B were not employed, a bias of the exhaust gases G towards the outer region of the converter inlet passage 61 would be considerable. Hence, when the exhaust gases G are introduced into the first catalytic converter 51 having been so biased in the manner described above, the exhaust gases G flow in a relatively large amount into that portion of the first catalytic converter 51, which is aligned with the outer region of the converter inlet passage 61, accompanied by reduction of the efficiency of utilization of the catalyst employed. In view of this, in the illustrated embodiment, the first and second curved rectifying plates 62A and 62B are employed within the turnback tube portion 49*b*, where the exhaust gases G are U-turned so as to flow into the first catalytic converter 51, to thereby minimize the biased flow of the exhaust gases G as hereinabove described.

Figure 13A:
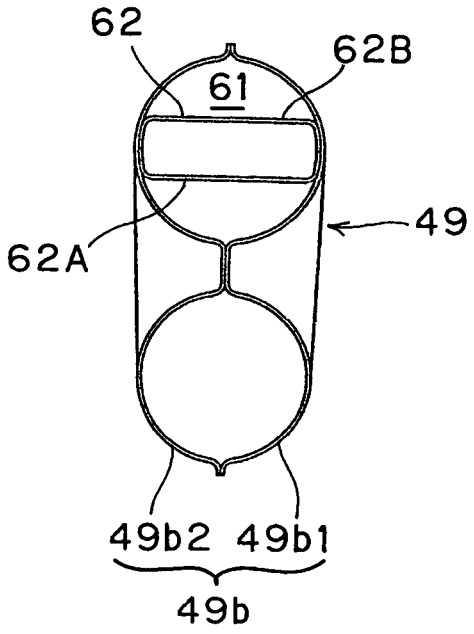
FIG. 13A is a cross-sectional view taken along the line XIIIA-XIIIA in FIG. 12.
Figure 13B:
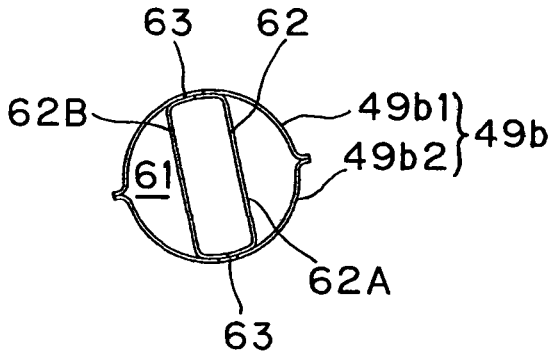
FIG. 13B is a cross-sectional view taken along the line XIIIB-XIIIB in FIG. 12.

Referring to FIGS. 13A and 13B illustrating respective cross-sections of the turnback tube portion 49*c* taken along the lines XIIIA-XIIIA and XIIIB-XIIIB in FIG. 12, the first and second rectifying plates 62A and 62B are positioned at a location intermediate of the inner diameter of the turnback tube portion 49*b* so as to extend parallel to each other. The first and second rectifying plates 62A and 62B are defined by respective opposite wall portions of a pipe 62 of a generally rectangular sectional shape, which are flattened, leaving opposite lateral wall portions curved to follow the curvature of the wall defining the turnback tube portion 49*b*.

The turnback tube portion 49*b* of the exhaust introducing tube 49 is made up of generally U-shaped tube halves 49*b*1 and 49*b*2 each having a pair of longitudinal side flanges. While the pipe 62 is sandwiched between those U-shaped tube halves 49*b*1 and 49*b*2 with the opposite lateral wall portions thereof held in contact with respective inner surfaces of those tube halves 49*b*1 and 49*b*2, the longitudinal side flanges of the first tube half 49*b*1 are welded together with the longitudinal side flanges of the second tube halve 49*b*2 and, at the same time, the pipe 62 so sandwiched is fixed in position inside the turnback tube portion 49*b* by means of welding (plug welding) applied to the opposite lateral wall portions of the pipe 62 through welding perforations 63 defined in the tube halves 49*b*1 and 49*b*2 as best shown in FIG. 12 and FIG. 13B. Thus, it will readily be seen that the two rectifying plates 62A and 62B can be prepared from the single pipe 62, rendering the turnback tube portion 49*b* to be easily assembled.

In any event, the first and second rectifying plates 62A and 62B in effect divide the interior of that portion of the turnback tube portion 49*b*, where they are disposed, into an intermediate passage portion delimited between the first and second rectifying plates 62A and 62B, an inner passage portion delimited between the first rectifying plate 62A and a portion of the outer periphery of the turnback tube portion 49*b*, and an outer passage portion delimited between the second rectifying plate 62B and the opposite portion of the outer periphery of the turnback tube portion 49*b*.

Figure 14A:
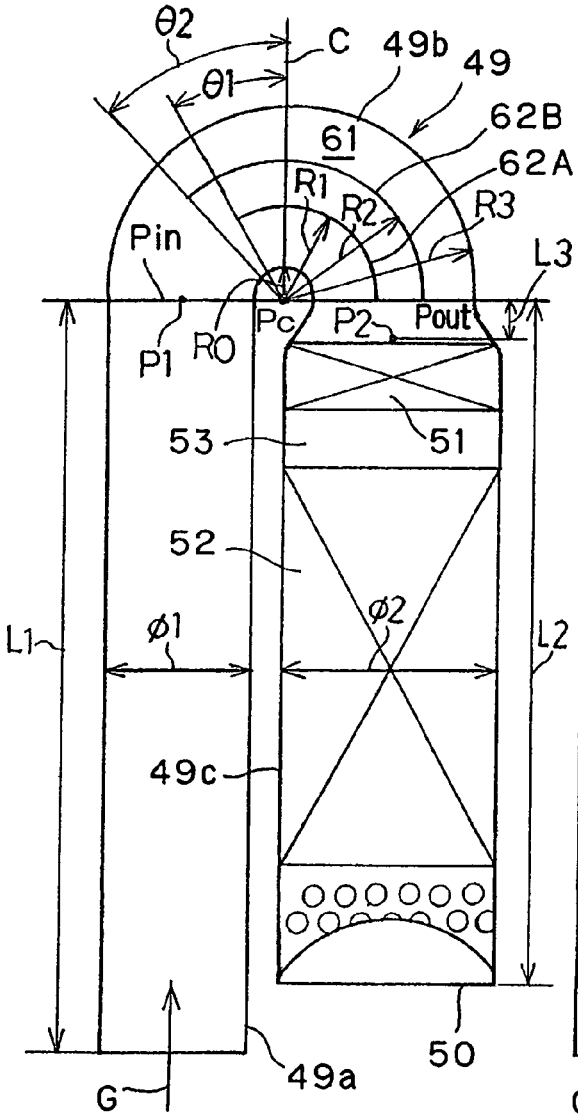
FIG. 14A is a schematic diagram showing the exhaust introducing passage having the rectifying plate installed therein, which is disposed within the muffler shown in FIG. 4.

If the first and second rectifying plates 62A and 62B shown in FIG. 12 are too lengthy, the resistance to the flow of the exhaust gases G will increase, accompanied by increase of a pressure loss. In order to avoid this, each of the first and second rectifying plates 62A and 62B is, as best shown in FIG. 14A, so designed and so configured as to have a length extending in upstream and downstream sides of and across the plane of symmetry C of the shape of a figure "U" represented by the turnback tube portion 49*b*. By so doing, the exhaust gases G can be rectified at a region adjacent the plane of symmetry C, at which the biased flow of the exhaust gases G under the influence of the centrifugal force occurs most, to thereby suppress the bias of the exhaust gases flow.

Referring specifically to FIG. 14A, in the illustrated embodiment, the first rectifying plate 62A, positioned inwardly relative to the second rectifying plate 62B, has such a length that an upstream end thereof can be positioned spaced an angle θ1 of about 23° in an upstream direction from the plane of symmetry C, whereas the second rectifying plate 62B has such a length that an upstream end thereof can be positioned spaced an angle θ2 of about 30° in the same upstream direction from the plane of symmetry C. On the other hand, respective downstream ends of those first and second rectifying plates 62A and 62B are positioned at the same location spaced an angle of 90° in a downstream direction from the plane of symmetry C.

With the respective lengths of the first and second rectifying plates 62A and 62B so chosen as described above, the first and second rectifying plates 62A and 62B are effective to suppress the pressure loss resulting from the increase of the resistance to the flow of the exhaust gases C, which would occur when they have too large length, thereby effectively suppressing the biased flow of the exhaust gases G.

Since the foregoing effects brought about by the use of the first and second rectifying plates 62A and 62B have been ascertained as a result of a series of experiments conducted and, accordingly, results of observation will now be described with particular reference to FIGS. 14A and 14B. In particular, FIG. 14A shows the exhaust introducing tube 49 having the two rectifying plates 62A and 62B disposed in the converter inlet passage 61 such as in the illustrated embodiment, whereas FIG. 14B shows the same exhaust introducing tube 49*a*, but having no rectifying plate employed for the purpose of comparison.

Figure 14B:
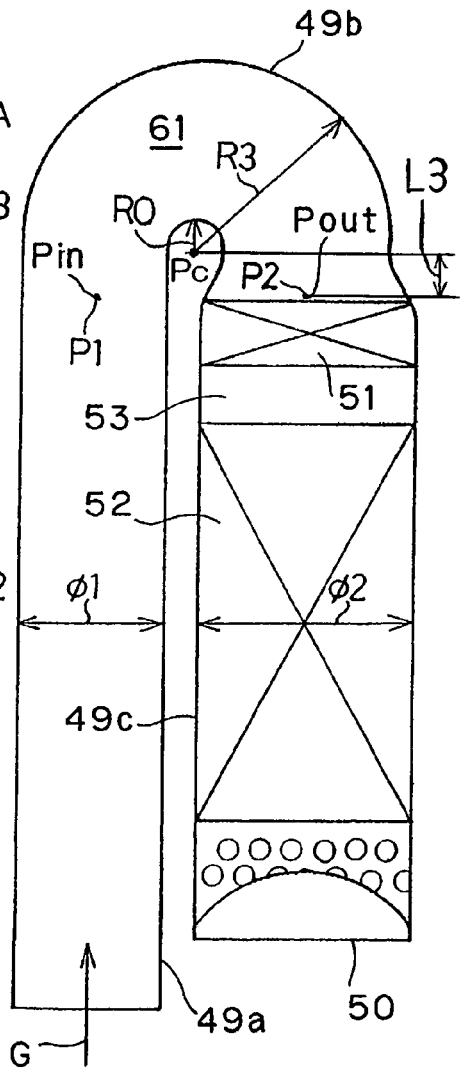
FIG. 14B is a view similar to FIG. 14A, showing the exhaust introducing passage having no rectifying plate, shown for the purpose of comparison.

As experimental conditions, in both of the inventive and comparative examples shown respectively in FIGS. 14A and 14B, the same design parameters were employed as far as the length L1 and the inner diameter ø1 of the upstream tube portion 49*a*, the length L2 and the inner diameter ø2 of the downstream tube portion 49*c*, the length L3 representing the distance from the outlet of the first and second rectifying plates 62A and 62B or the center Pc of the radius of curvature of the turnback tube portion 49*b* to the outlet pressure measurement point Pout and the minimum and maximum radiuses of curvature R0 and R3 of the turnback tube portion 49*b* are concerned. Specifically, the length L1 and the inner diameter ø1 of the upstream tube portion 49*a* were so chosen to be 230 mm and 43 mm, respectively; the length L2 and the inner diameter ø2 of the downstream tube portion 49*c* were so chosen to be 210 mm and 46 mm, respectively; and the minimum and maximum radiuses of curvature R0 and R3 of the turnback tube portion 49*b* were so chosen to be 8 mm and 52 mm, respectively.

In the exhaust introducing tube 49 shown in FIG. 14A, the first rectifying plate 62A, positioned inwardly of the second rectifying plate 62B, was so curved as to have the radius of curvature R1=22 mm, whereas the second rectifying plate 62B, positioned outwardly of the first rectifying plate 62A, was so curved as to have the radius of curvature R2=36 mm.

Using those experimental conditions, the exhaust gases G of a gauge pressure of 2,700 Pa measured at the inlet to the upstream tube portion 49*a* was introduced in the exhaust introducing tube 49 at a flow velocity of 100 m/S, and respective pressures P1 and P2 at inlet and outlet pressure measurement points Pin and Pout in the converter inlet passage 61 in both of the inventive and comparative examples were measured.

As a result, it has been ascertained that the difference in pressure at the inlet and the outlet, that is, (P1−P2) indicative of the pressure loss at the turnback tube portion 49*b*, was 24% smaller in the inventive example, in which the rectifying plates 62A and 62B were employed as shown in FIG. 14A, than in the comparative example, in which no rectifying plate was employed as shown in FIG. 14B. Also, with the simulation experiment conducted, it has been ascertained that in the inventive example shown in FIG. 14A, portion of the exhaust gases G introduced into the converter inlet passage 61 can be, after having passed through an intermediate passage portion between the first and second rectifying plates 62A and 62B and an inner passage portion between the first rectifying plate 62A and a portion of the outer periphery of the turnback tube portion 49*b*, guided along the first and second rectifying plates 62A and 62B into the first catalytic converter 51, and that the outward bias of the flow of the exhaust gases G within the converter inlet passage 61 can be suppressed, that is, the flow of the exhaust gases G through the converter inlet passage 61 can be rectified. Accordingly, it has been ascertained that where the two rectifying plates 62A and 62B are employed as shown in FIG. 14A under the condition as discussed above, a sufficient rectifying effect and suppression of the pressure loss with respect to the flow of the exhaust gases G can be obtained in a balanced manner.

It is to be noted that although reference has been made to the use of the two rectifying plates 62A and 62B, the present invention may not be always limited thereto and one or three or more rectifying plates can be employed and that the rectifying plate or plates employed may have any other suitable shape than that discussed above. It is also to be noted that the position where the rectifying plates 62A and 62B are disposed may not be limited to that intermediate of the diameter of the exhaust introducing tube, but may be disposed on one side of the point intermediate of the diameter thereof.

The details of the muffler side cover 30 fitted to a lateral portion of the muffler 23 as shown in FIG. 5 will now be described. As shown in FIG. 1, the muffler 23 is positioned on a level flush with the bottom of the motorcycle engine E at a location between the rear face of the engine E and the rear wheel 8 and, therefore, a rear portion of the muffler 23 occupies a position proximate to the drive chain 11. For this reason, a rear upper portion of the outer surface of the muffler casing 30 tends to be contaminated with greases scattered from the circulating drive chain 11. Considering that the muffler casing 30 is heated to elevated temperatures by the exhaust gases G flowing therethrough, deposits of greases tend to get stuck on that rear upper surface portion of the muffler casing 30, resulting in impairment of the appearance of the muffler 23. In view of this, the muffler side cover 39 is employed to cover that outer surface portion of the muffler 23, which is likely to be contaminated with grease.

Figure 15:
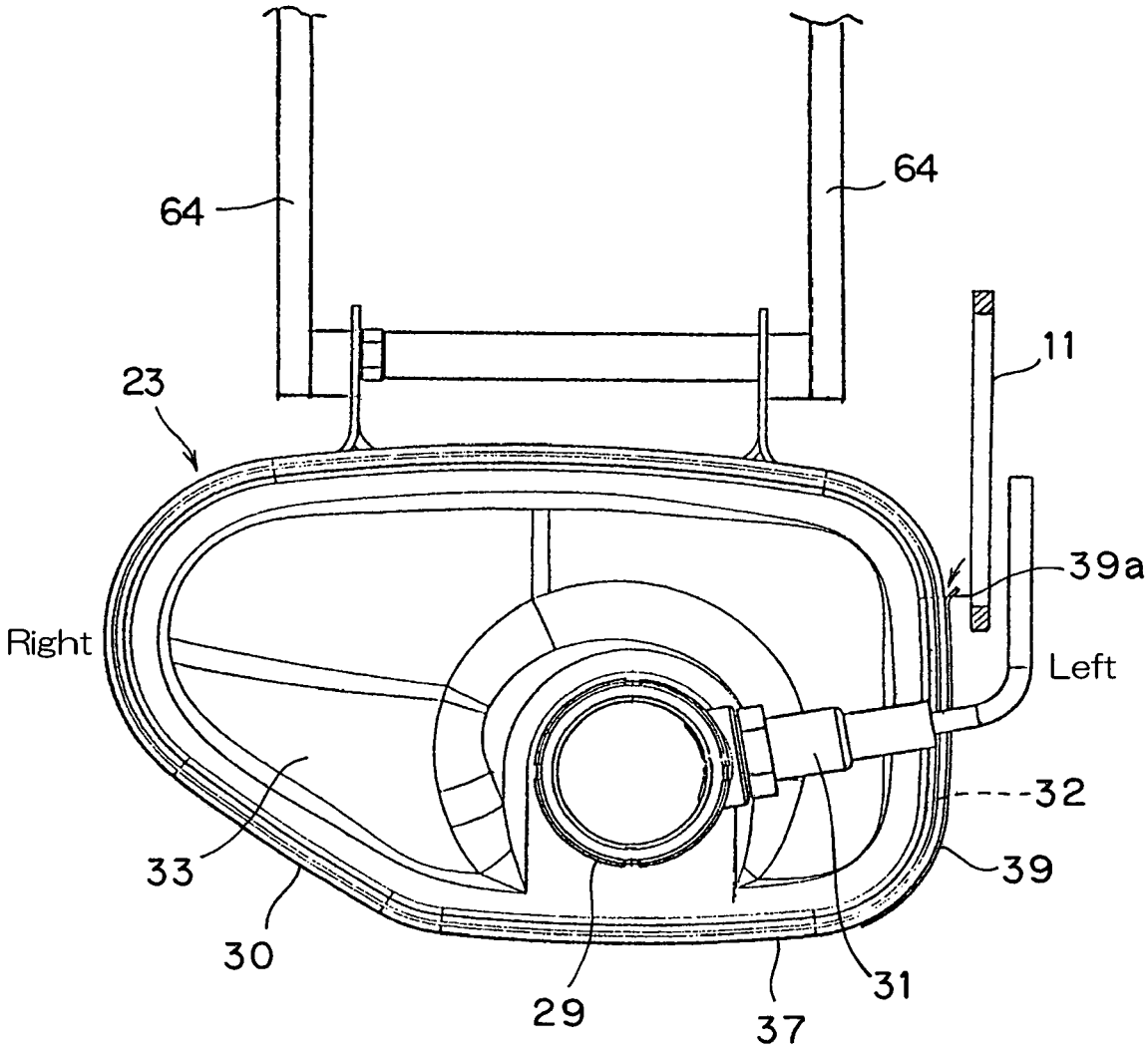
FIG. 15 is a front elevational view of the muffler shown in FIG. 4.
Figure 16:
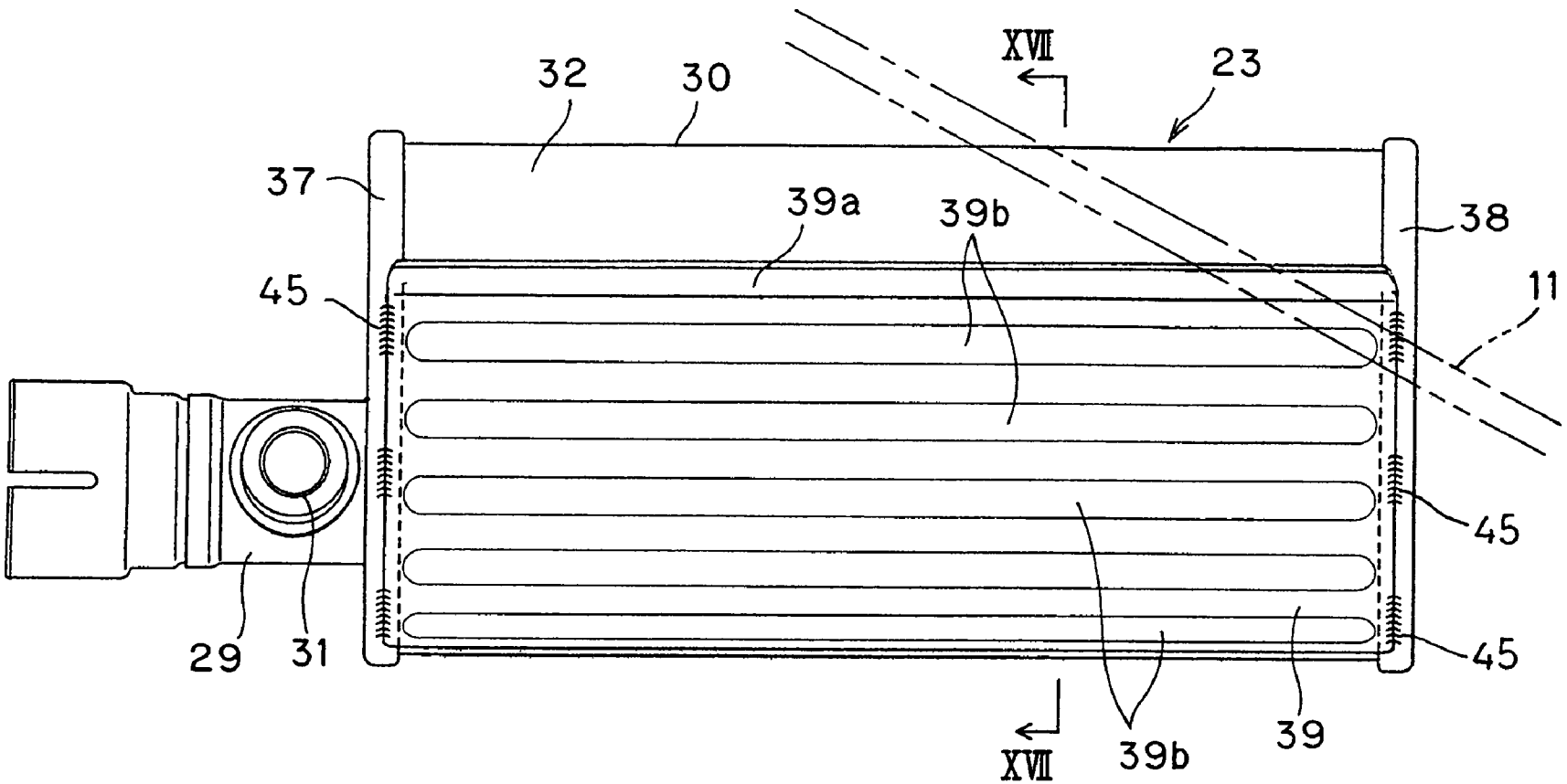
FIG. 16 is a side view of the muffler shown in FIG. 4.
Figure 17:
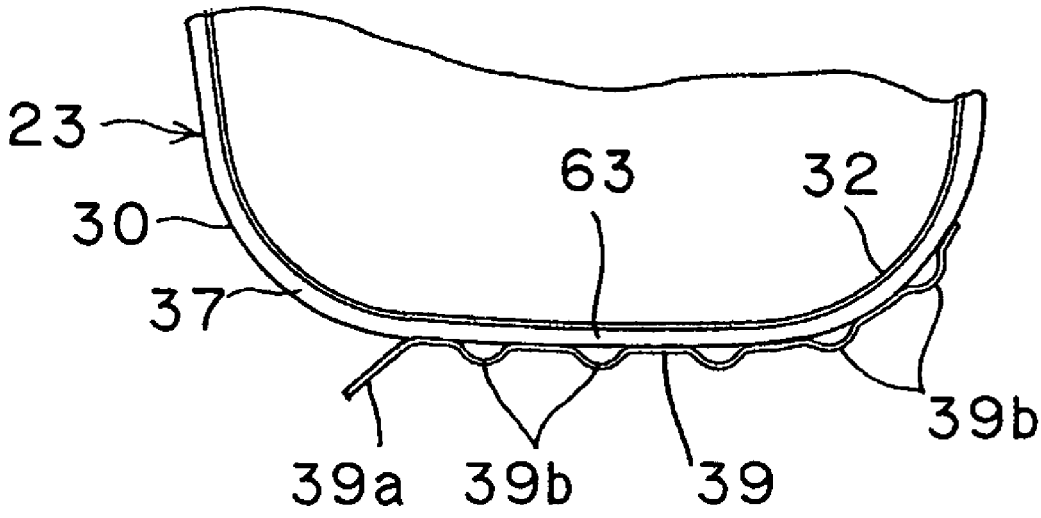
FIG. 17 is a cross-sectional view taken along the line XVII-XVII in FIG. 16.

Reference will now be made to FIG. 15, showing a front elevational view of the muffler 23 provided with the muffler side cover 39, to FIG. 16 showing a right side view of the muffler 23 and also to FIG. 17 showing a cross-section taken along the line XVII-XVII in FIG. 16. The muffler side cover 39 is in the form of a plate member and, as best shown in FIG. 15, is of such a size sufficient to cover a substantially entire area of a left side surface of the muffler casing 30, including a rear upper corner portion of the muffler viewable from the outside of the motorcycle frame structure, which is likely to be contaminated with grease scattered from the drive chain 11.

As best shown in FIG. 16, the muffler side cover 39 has its opposite ends welded to the front and rear flanged portions 37 and 38 of the muffler casing 30 while straddling therebetween. It is to be noted that as shown in FIG. 15, the muffler 23 is supported by the swing arm bracket (not shown) through left and right pairs of stays 64.

As FIG. 16 makes it clear, the front and rear flanged portions 37 and 38 of the muffler casing 30, to which the muffler side cover 39 are welded, protrudes a certain distance laterally outwardly from the outer peripheral surface of the muffler casing 30. Accordingly, the muffler side cover 39 straddling the muffler casing 30 with its opposite ends welded to the front and rear flanged portions 37 and 38 has a gap between it and the tubular body 32 as shown in FIG. 17. This gap defines a space 63 for receiving therein droplets of grease scattered from the drive chain 11.

The muffler side cover 39 has an upper edge portion bent to have a guide wall 39*a* extending upwardly slantwise in a direction outwardly of the muffler casing 30 for guiding droplets of greases to flow into the space 63. The muffler side cover 39 is also formed with a plurality of elongated projections 39*b* so as to extend parallel to each other in a direction generally conforming to the longitudinal sense of the muffler casing 30 for the purpose of reinforcing the muffler side cover 39.

In the muffler 23 with the muffler side cover 39 fitted thereto in the manner described above, the droplets of grease scattered from the chain 11 can be guided into the space 63 by means of the guide wall 39*a* and subsequently deposit on an outer left surface of the muffler casing 30 and the inner surface of the muffler side cover 39 confronting the muffler casing 30. Although the grease deposited on the tubular body 32 of the muffler casing 30 may get stuck thereon by the effect of the elevated temperature of the muffler casing 30, the grease so deposited can be covered up by the muffler side cover 39 to such an extent that the grease deposits can no longer be viewable from the outside and, therefore, an appealing feature of the muffler 23, which would otherwise be reduced with grease deposition, can be maintained. It is to be noted that an upper region of the muffler casing 30 above the muffler side cover 39 is covered by the engine E or other components and is not, therefore, viewable from a left side of the motorcycle frame structure.

Also, the outer surface of the muffler side cover 39 will hardly be contaminated with deposits of the grease owning to the guide wall 39*a*. However, even if the droplets of grease deposit on the outer surface of the muffler side cover 39, those deposits of grease on the outer surface of the muffler side cover 39 can easily and readily be swept off. This is because since the muffler side cover 39 is spaced from the tubular body 32 of the muffler casing 30 with the space 63 intervening therebetween, the muffler side cover 39 will not be heated so much to the elevated temperature through thermal conduction from the tubular body 32 and, hence, the grease deposits on the outer surface of the muffler side cover 39 will not get stuck thereon. Also, the muffler side cover 39 is so reinforced in the presence of the elongated projections 39*b* and, therefore, the muffler side cover 39 will not be vibrated due to the motorcycle body vibration during the run of the motorcycle to such an extent as to generate fluttering sounds.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A catalytic converter-incorporated exhaust system, which comprises:

an exhaust tube through which exhaust gases emitted from an engine flows;

a muffler fluidly connected with a downstream end of the exhaust tube and including a muffler casing, the muffler casing having at least one expansion chamber defined therein;

an exhaust introducing passage for introducing the exhaust gases from the exhaust tube to the expansion chamber;

an catalytic converter assembly for substantially purifying the exhaust gases mounted in an downstream portion of the exhaust introducing passage and positioned upstream of the expansion chamber;

an exhaust composition detecting sensor disposed within the exhaust introducing passage at a location outside the muffler casing, wherein the exhaust introducing passage is defined by a tube of a shape extending from one end wall of the muffler casing, which has an inlet, to the opposite end wall thereof through an interior of the muffler casing and having a generally U-shaped turnback tube portion around which the exhaust introducing passage is turned backwards to extend towards such one end wall of the muffler casing;

wherein the muffler casing has an upstream expansion chamber defined therein at a location frontward of the muffler casing for receiving the exhaust gases having passed through the catalytic converter assembly and also has one or more downstream expansion chambers defined therein at a location rearwardly of the upstream expansion chamber; and wherein the catalytic converter assembly is connected with a downstream portion of the generally U-shaped turnback tube portion and disposed at a location between the generally U-shaped turnback tube portion and the upstream expansion chamber.

2. The catalytic converter-incorporated exhaust system as claimed in claim 1, wherein the catalytic converter assembly comprises a first catalytic converter positioned upstream with respect to a direction of flow of the exhaust gases and a second catalytic converter positioned downstream of the first catalytic converter and spaced from the first catalytic converter with a gap intervening therebetween.

3. The catalytic converter-incorporated exhaust system as claimed in claim 1, wherein the muffler casing is provided with a plurality of expansion chambers defined therein by means of partition walls, and further comprising a plurality of communicating tubes communicating between the expansion chambers or between one of the expansion chambers and an outside, at least one of the communicating tubes has at least one end face thereof, which is held in abutment with the partition wall, one end of this at least one of the communicating tubes having a peripheral wall formed with an opening through which the exhaust gases flow between the communicating tube and the expansion chamber.

4. The catalytic converter-incorporated exhaust system as claimed in claim 1 wherein the exhaust tube has an S shape from the engine to the muffler.

5. The catalytic converter-incorporated exhaust system as claimed in claim 1, wherein a pair of spaced curved rectifying plates are mounted in the U-shaped turnback tube to counter a centrifugal force for turning the exhaust gases in the U-shaped turnback tube.

6. The catalytic converter-incorporated exhaust system as claimed in claim 1, wherein the generally U-shaped turnback tube portion is provided therein with a rectifying plate extending in a direction of flow of the exhaust gases for dividing an interior of the generally U-shaped turnback tube portion.

7. The catalytic converter-incorporated exhaust system as claimed in claim 6, wherein the rectifying plate is so curved as to follow a curvature of the generally U-shaped turnback tube portion.

8. The catalytic converter-incorporated exhaust system as claimed in claim 7 wherein a second rectifying plate is spaced from the rectifying plate in the U-shaped turnback tube portion.

9. The catalytic converter-incorporated exhaust system as claimed in claim 1 wherein an exhaust buffer member is connected directly to an output of the catalytic converter assembly in the upstream expansion chamber.

10. The catalytic converter-incorporated exhaust system as claimed in claim 9, wherein the exhaust buffer has a closed cylinder configuration with an inward spherical shape end closing the cylinder and apertures are provided in a cylinder wall that surrounds the spherical shape end for releasing exhaust gas into the upstream expansion chamber.

11. A motorcycle with an exhaust system, said exhaust system comprising:

an exhaust tube through which exhaust gases emitted from an engine flow;

a muffler fluidly connected with a downstream end of the exhaust tube and including a muffler casing, the muffler casing having at least one expansion chamber defined therein;

an exhaust introducing passage for introducing the exhaust gases from the exhaust tube to the expansion chamber;

an catalytic converter assembly for substantially purifying the exhaust gases mounted in an downstream portion of the exhaust introducing passage and positioned upstream of the expansion chamber;

an exhaust composition detecting sensor disposed within the exhaust introducing passage at a location outside the muffler casing, wherein the exhaust introducing passage is defined by a tube of a shape extending from one end wall of the muffler casing, which has an inlet, to the opposite end wall thereof through an interior of the muffler casing and having a generally U-shaped turnback tube portion around which the exhaust introducing passage is turned backwards to extend towards such one end wall of the muffler casing;

wherein the muffler casing has an upstream expansion chamber defined therein at a location frontward of the muffler casing for receiving the exhaust gases having passed through the catalytic converter assembly and also has one or more downstream expansion chambers defined therein at a location rearwardly of the upstream expansion chamber; and wherein the catalytic converter assembly is connected with a downstream portion of the generally U-shaped turnback tube portion and disposed at a location between the generally U-shaped turnback tube portion and the upstream expansion chamber.

12. The motorcycle as claimed in claim 11, wherein the muffler of the exhaust system is positioned between a rear face of the engine and a rear wheel of the motorcycle.

13. In a motorcycle having an engine that is provided fuel by a fuel supply control device, the improvement of an exhaust system to purify and reduce noise in the exhaust gases, comprising:

a pair of exhaust tubes extending downward from the engine;

a coupling assembly for receiving the downstream ends of the pair of exhaust tubes;

a muffler casing with an inlet tube at a first end connected to the coupling assembly and a plurality of expansion chambers located in the muffler casing between the first end and an opposite second end;

an exhaust composition detecting sensor mounted between the coupling assembly and the muffler casing, the exhaust composition detecting sensor is mounted adjacent the outside of the muffler casing adjacent the first end and operatively connected to the fuel supply control device;

an exhaust introducing passage connected to the inlet tube including an upstream tube portion extending from the inlet tube substantially through the muffler casing to the second end;

a U-shaped tube connected to the upstream tube portion and positioned adjacent the second end of the muffler casing; and a catalytic converter assembly, for substantially purifying the exhaust gases, connected to a downstream end of the U-shaped tube, the catalytic converter assembly releasing the treated exhaust gas immediately adjacent the first end of the muffler casing in a first expansion chamber of the plurality of expansion chambers, the subsequent expansion chambers of the plurality of expansion chambers modulate the exhaust gas sound before release of the exhaust gases from the muffler casing.

14. The motorcycle of claim 13 wherein the pair of exhaust tubes have an S-shaped configuration.

15. The motorcycle of claim 13 wherein the muffler casing includes a partial muffler side cover extending over a portion of the muffler casing with outwardly extending guide walls for guiding droplets of grease.

* * * * *